US008240481B2

(12) United States Patent
Kato

(10) Patent No.: US 8,240,481 B2
(45) **Date of Patent: *Aug. 14, 2012**

(54) SIFTER

(75) Inventor: Fumio Kato, Handa (JP)

(73) Assignee: Tsukasa Co., Ltd., Handa-Shi, Aichi (JP)

( * ) Notice: Subject to any disclaimer, the term of this patent is extended or adjusted under 35 U.S.C. 154(b) by 64 days.

This patent is subject to a terminal disclaimer.

(21) Appl. No.: 12/887,504

(22) Filed: Sep. 21, 2010

(65) Prior Publication Data

US 2011/0005980 A1 Jan. 13, 2011

Related U.S. Application Data

(63) Continuation-in-part of application No. 12/196,373, filed on Aug. 22, 2008, now Pat. No. 7,896,163, which is a continuation of application No. PCT/JP2007/000506, filed on May 10, 2007.

(30) Foreign Application Priority Data

May 10, 2006 (JP) ..... 2006-131904

(51) Int. Cl.
*B07B 1/20* (2006.01)

(52) U.S. Cl. ..... 209/284; 209/273; 209/283; 209/300

(58) Field of Classification Search ..... 209/22, 209/23, 44.3, 262, 285, 286, 300, 305, 306, 209/714; 55/302, 471, 473
See application file for complete search history.

(56) References Cited

U.S. PATENT DOCUMENTS 1,921,750 A * 8/1933 Heinrich et al. ..... 209/273
2,389,715 A 11/1945 Beardsley
2,523,259 A 9/1950 Aber
3,735,873 A * 5/1973 Bergstedt ..... 210/415
3,928,188 A * 12/1975 Link et al. ..... 209/250
4,154,574 A 5/1979 Keirle et al.
4,202,759 A 5/1980 Krolopp et al.
4,294,692 A 10/1981 Keller
4,582,202 A 4/1986 Stone et al.
4,680,108 A 7/1987 Ahs
RE33,752 E * 11/1991 Poss ..... 241/74
5,458,246 A 10/1995 Thom, Jr.
5,570,790 A 11/1996 Rumpf et al.

(Continued)

FOREIGN PATENT DOCUMENTS

DE 54985 A 1/1891

(Continued)

*Primary Examiner* — Joseph C Rodriguez
(74) *Attorney, Agent, or Firm* — Matthias Scholl, PC; Matthias Scholl

(57) ABSTRACT

A sifter comprising: a receiver having a supply chamber; a sieve assembly having a sieving chamber coupled to the supply chamber; a rotor having a rotating shaft laterally arranged to pass through the supply chamber and the sieving chamber; a drum having a circular cross-section and having a larger diameter than the diameter of the rotating shaft, the drum being extended in at least space of the sieving chamber and arranged coaxially with the sieve; a cylindrical sieve located inside the sieving chamber and arranged coaxially with the rotating shaft; a stirring rotor located in an inner area of the sieving chamber inside the sieve comprising a rotating blade attached to the rotating shaft; an extraction member; and an outlet for discharging powder passing through the sieve from the inner area to the outer area.

2 Claims, 21 Drawing Sheets

U.S. PATENT DOCUMENTS

| | | | | |
|---|---|---|---|---|
| 5,593,042 | A | 1/1997 | Keller | |
| 5,601,690 | A * | 2/1997 | Gauld et al. | 162/55 |
| 5,758,778 | A | 6/1998 | Kershner | |
| 7,896,163 | B2 * | 3/2011 | Kato | 209/284 |
| 2004/0011710 | A1 | 1/2004 | Kato et al. | |
| 2006/0102527 | A1 | 5/2006 | Kato et al. | |
| 2006/0237347 | A1 | 10/2006 | Kato et al. | |
| 2009/0020460 | A1 | 1/2009 | Kato et al. | |

FOREIGN PATENT DOCUMENTS

| | | | |
|---|---|---|---|
| FR | 677679 | A | 3/1930 |
| FR | 2 578 177 | A1 | 9/1986 |
| GB | 228899 | A | 1/1926 |
| GB | 281509 | A | 12/1927 |
| JP | 63-69577 | A | 3/1988 |
| JP | S63-69577 | A | 3/1988 |
| JP | H02-12487 | | 1/1990 |
| JP | 3-131372 | A | 6/1991 |
| JP | H04-78968 | | 7/1992 |
| JP | 11-244784 | A | 9/1999 |
| JP | 2001-347173 | | 12/2001 |
| JP | 2003-326180 | A | 11/2003 |
| JP | 3492676 | B2 | 2/2004 |
| WO | 2004060584 | A1 | 7/2004 |
| WO | 2005102543 | A1 | 11/2005 |

* cited by examiner

SIFTER

CROSS-REFERENCE TO RELATED APPLICATIONS

This application is a continuation in part of U.S. Ser. No. 12/196,373 filed on Aug. 22, 2008, now pending, which is a continuation of International Patent Application No. PCT/JP2007/000506, with an international filing date of May 10, 2007, designating the United States, which is based on Japanese Patent Application No. 2006-131904, filed May 10, 2006. The contents of all of these specifications, including any intervening amendments thereto, are incorporated herein by reference.

BACKGROUND OF THE INVENTION

1. Field of the Invention

This invention relates to a sifter for sifting powder, e.g., a food article, a chemical, or a drug in a powder form.

2. Brief Description of Related Arts

In conventional chute sifters, powder commonly falls through a chute into a sieving chamber and is stirred by rotation of rotating blades attached to and arranged coaxially with a rotating shaft, which is located at the center of the sieving chamber and is rotated by means of a motor. Such conventional chute sifters are described, e.g., in Japanese Laid-Open Patent Nos. S63-69577, H03-131372, and H11-244784. A structurally similar pneumatic conveying in-line sifter with a rotating shaft and rotating blades is also known from Japanese Patent Publication No. 3492676. This sifter is effectively used for separation of a powdery substance from air in an air-powder mixture, classification of the separated powdery substance, and removal of foreign substances from the separated powdery substance.

However, in these conventional sifters, the rotating shaft located at the center of the sieving chamber has a fixed diameter that is smaller than the diameter of a sieve provided in the sieving chamber. The sieving chamber has a relatively wide space to enable a large flow of the powder or the air-powder mixture. Particularly as shown in FIG. 19, an excess load is applied to a partial area of a screen 170 in a sieve 107 corresponding to an angular range N from a 5 o'clock angle to an 8 o'clock angle. Namely, only the partial area of the screen 170 is effectively being used for sieving. The sieving chamber has too large of a space to sufficiently scoop up the powder by means of the rotating blades. The remaining area of the screen 170 other than the partial area corresponding to the angular range N is not effectively used for sieving. The powder is localized in the partial area of the angular range N. This undesirably accelerates deterioration of the screen and shortens the lifetime of the sieve, while limiting the sieving efficiency.

Conventional sifters also disadvantageously cause separation of powders in a powder mixture comprising various grain sizes, thus lowering the quality of the powder mixture. Conventional sifters also have problems of a large pressure loss and a relatively large amount of air used for sieving.

SUMMARY OF THE INVENTION

In order to eliminate the drawbacks explained above, the invention provides in one embodiment a sifter comprising: a receiver having a supply chamber for receiving material to be sifted from an upstream via an inlet; a sieve assembly having a sieving chamber coupled to and communicating with the supply chamber; a rotor having a rotating shaft laterally arranged to pass through the supply chamber and the sieving chamber; a drum having a circular cross-section and having a larger diameter than the diameter of the rotating shaft, the drum being extended in at least space of the sieving chamber and arranged coaxially with the sieve in an axial direction of the rotating shaft; a cylindrical sieve located inside the sieving chamber and arranged coaxially with the rotating shaft; a stirring rotor located in an inner area of the sieving chamber inside the sieve comprising a plurality of rotating blades attached to the rotating shaft to push the material to be sifted from the inner area to an outer area of the sieving chamber outside the sieve, the stirring rotor being attached to an outer circumferential face of the drum; an extraction member for enabling removal of oversize powder or foreign substances trapped by the sieve from the inner area; and an outlet for discharging powder passing through the sieve from the inner area to the outer area.

In the sifter according to this embodiment, the drum attached to the rotating shaft narrows the space of the sieving chamber to reduce the pressure loss and decrease the amount of gas (air) used for sieving. The narrowed space of the sieving chamber increases an effective area of a screen of the sieve and extends the life of the sieve. The powder is not localized in part (typically the center part) of the screen but is homogeneously dispersed to ensure stable sieving operation. This arrangement prevents the powder from being accumulated on the outer surface of the screen and reduces retention of the powder to shorten its floating time, thus enhancing the sieving yield and increasing the amount of sieved powder per unit time. In food industries, the sifter of this structure is effectively applied to reduce powder retention space inside the screen and thereby lower the potential for separation of powders in a powder mixture of various grain sizes.

In one class of this embodiment, the rotating blades protrude in a radial direction from the drum terminating close to an inner circumferential face of the sieve and extend in a direction parallel to or inclined with respect to the axial direction of the rotating shaft, and the rotating blades are arranged at even intervals around the circumference of the drum. This arrangement ensures homogeneous dispersion of the powder and enables uniform sieving.

In another class of this embodiment, the drum has a front end extending from the inner area of the sieving chamber inside the sieve to the supply chamber. The rotation of the drum ensures smooth introduction of the powder into the sieving chamber.

In another class of this embodiment, the drum has a conical front portion having a front end, and the front end is connected to the rotating shaft. This arrangement effectively reduces the loss of pressure.

In another class of this embodiment, the rotating shaft is cantilevered and comprises: a fixed end supported by a bearing in the receiver, and a free end where the drum is formed and which is arranged to pass through the drum. This arrangement desirably reduces the overall weight of the drum and simplifies the structure of the drum.

In another class of this embodiment, the rotating blade is supported by a support member protruding in the radial direction from the drum, and a clearance is formed between the drum and the rotating blade. This arrangement desirably reduces retention of the powder on the outer surface of the drum.

In another class of this embodiment, a partition plate is formed inside the drum in the radial direction to partition the inner area of the drum.

In another class of this embodiment, the material to be sifted is critically powder or air-powder mixture.

In another class of this embodiment, the sifter is an inline sifter or a stand-alone sifter.

BRIEF DESCRIPTION OF THE DRAWINGS

The invention is described hereinbelow with reference to accompanying drawings, in which.

Legend: 1—sifter; 2—receiver; L1—upstream line; 3—inlet; 4—sieve assembly; 5—rotating shaft; 6—drum; 7—sieve; 8—beater; 9—inspection door; L2—downstream line; 10—extraction member; 11—motor; 12—coupling mechanism; 20—supply casing; 21—supply chamber; 22—bearing chamber; 23—partition wall; 24—shaft hall; 25—first bearing; 26—second bearing; 40—sieve casing; 41—sieving chamber; 42—outlet; 43—inner area; 44—outer area; 45—fixing element; 50—shaft base; 51—free end of the rotating shaft; 60—conical body; 61—cylindrical body; 62—disk body; 63—wheel; 64—rib; 65—rib; 66—clearance; 70—screen; 71—screen fixing element; 201—sifter; 208—beater; 206—drum; 208*a*—beater; 208*b*—beater; 209*a*, 209*b* and 209*c*—inspection doors; 301—sifter; 308, 308*a*, and 308*b*—beaters; 308*c*—rib; 309*c*—inspection door; 401—sifter; 421—supply chamber; 450—shaft base; 408*a* and 408*b*—paddles; 408—beaters; 421—supply chamber; 443—inner area; 501—sifter; 508*a* and 509*b*—paddles; 508—beater; 506—drum; 568—support member; 566—clearance; 601—sifter; 608*a* and 608*b*—paddles; 608—beater; and 606—drum.

DETAILED DESCRIPTION OF THE PREFERRED EMBODIMENTS

Embodiments of the invention are described below in Examples 1 to 7 with reference to the accompanied drawings.

EXAMPLE 1

Figure 1A:
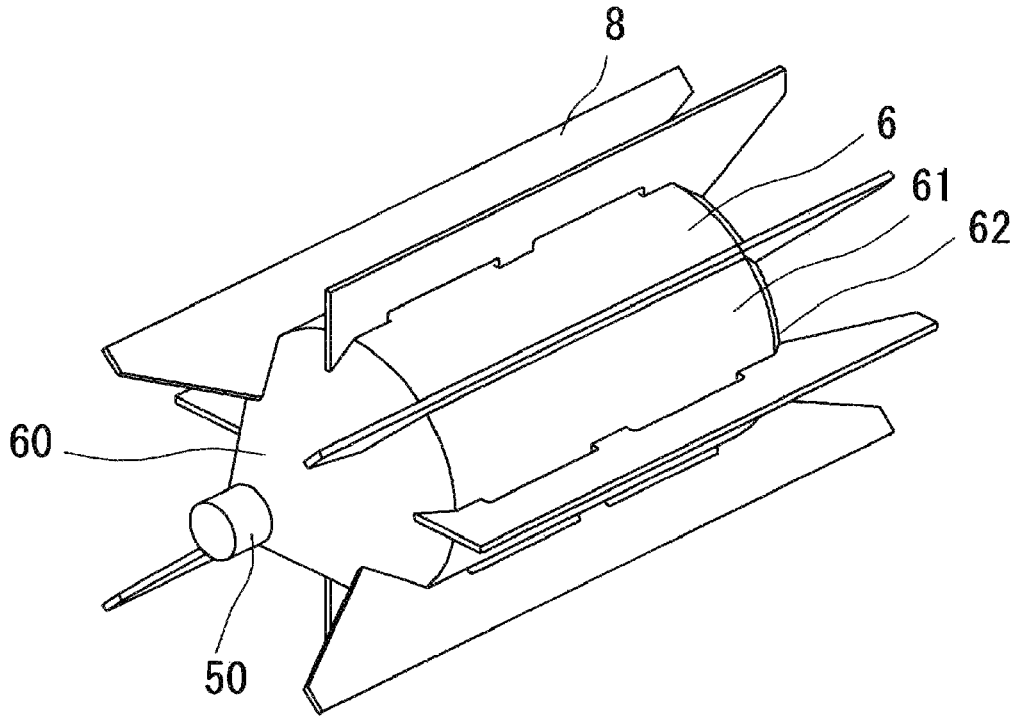
FIGS. 1(*a*) and 1(*b*) are perspective views showing a rotating shaft, drum, and beaters of the sifter described in Example 1.
Figure 1B:
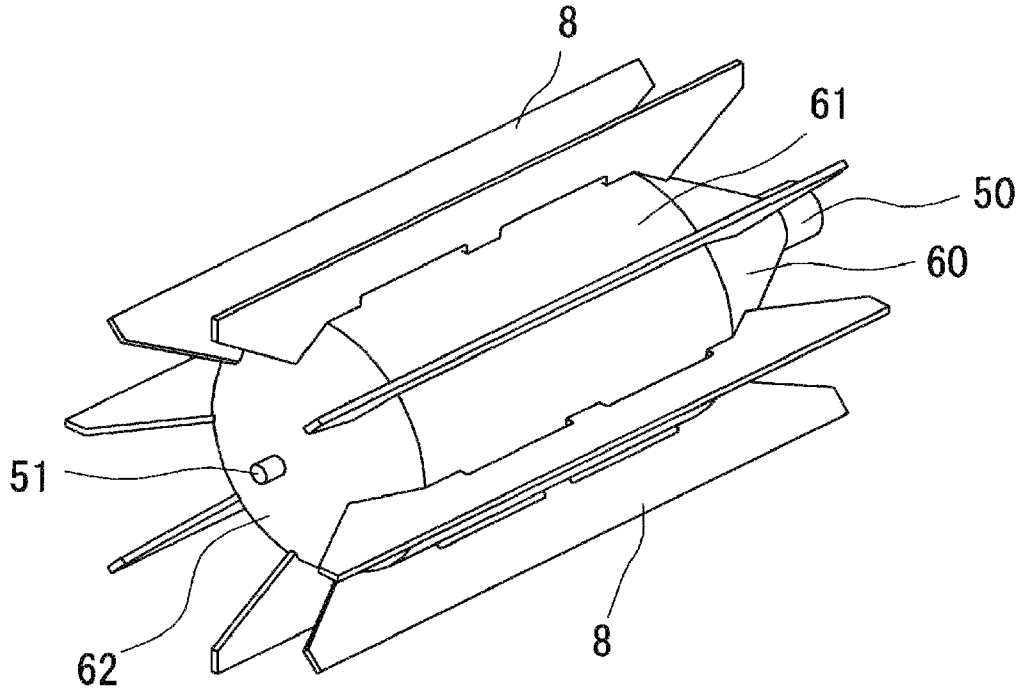
Figure 2:
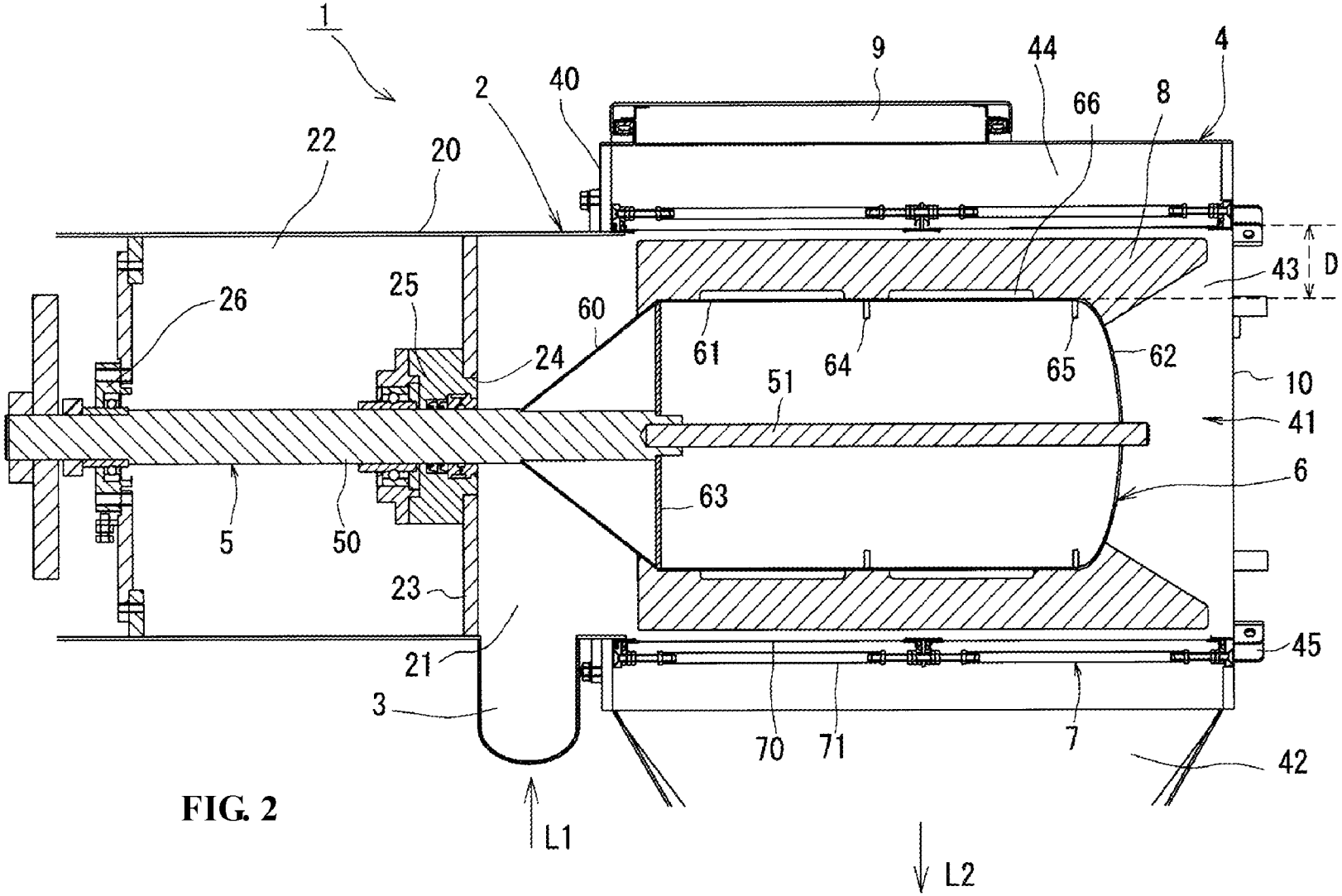
FIG. 2 is a longitudinal central cross-sectional view of the sifter described in Example 1.
Figure 3:
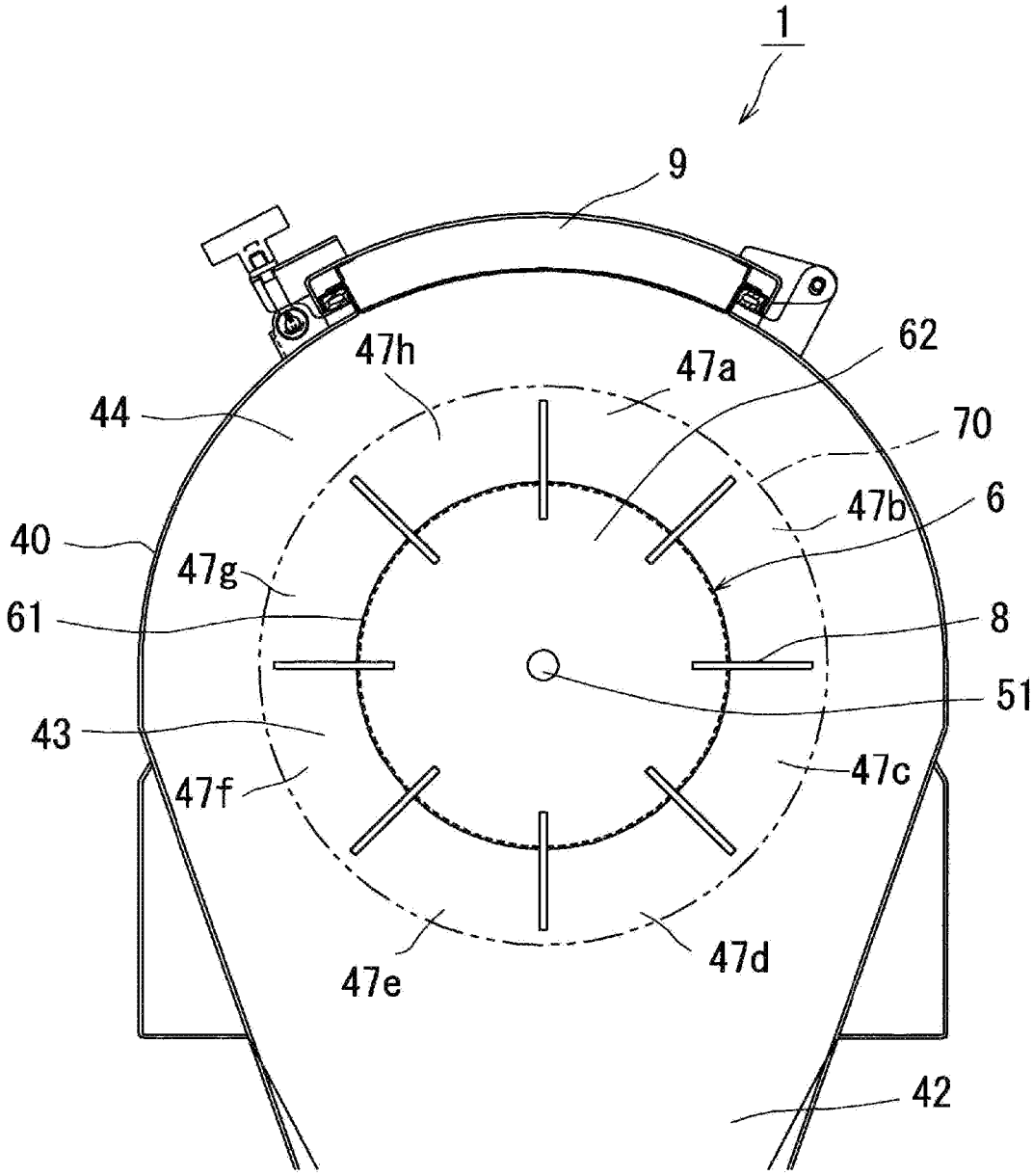
FIG. 3 is a right side cross-sectional view of the sifter described in Example 1.

With reference to FIGS. 1-3, a pneumatic in-line sifter 1 with a mount (not shown) having support legs (not shown) comprises a receiver 2 designed to receive an air-powder mixture (i.e., pneumatically-conveyed powder); an inlet 3 connected to the receiver 2 and configured to introduce the powder supplied from an upstream line L1 via an upstream blower and an upstream rotary valve (not shown) to the receiver 2; a sieve assembly 4 coupled and communicating with the receiver 2 in a lateral direction; a rotating shaft 5 arranged in a horizontal direction to pass through the inside of the receiver 2 and the sieve assembly 4; a drum 6 attached to the rotating shaft 5, formed across the area of the receiver 2 and the sieve assembly 4 to have a larger diameter than that of the rotating shaft 5, and arranged in an axial direction of the rotating shaft 5 to be coaxial with a cylindrical sieve 7; and the cylindrical sieve 7 provided inside the sieve assembly 4, arranged around the rotating shaft 5 and the drum 6 to be coaxial with the rotating shaft 5 and the drum 6, and formed to have an inside communicating with the receiver 2.

The in-line sifter 1 also comprises beaters 8 integrated with the rotating shaft 5 and attached to an outer circumferential face of the drum 6 to function as rotating blades of a stirring rotor provided in a rotatable manner inside the sieve 7; an inspection door 9 designed to enable access for inspection and cleaning of the inner area of the in-line sifter 1; an extraction member 10 designed to enable removal of oversize powder and/or foreign substances trapped by the sieve 7 from the inner area to the outside of the sieve 7; a motor 11 (not shown) driven to rotate the rotating shaft 5, and a coupling mechanism 12 (not shown) constructed to link the rotating shaft 5 with the motor 11 by means of, for example, a pulley and a belt.

The structure of the in-line sifter 1 is described in detail hereinbelow. A filter unit and a relevant mechanism for removal of air from the sieve assembly 4 are neither specifically illustrated, nor explained herein. The details of the respective components of the in-line sifter 1 other than the rotating shaft 5, the drum 6, and the beaters 8, are described, for example, in Japanese Patent Publication No. 3492676. The sieve 7 is described in Intl. Pat. Appl. Publ. No. WO2004/060584A1.

With reference to FIG. 2, the receiver 2 comprises a cylindrical supply casing 20; a cylindrical supply chamber 21 designed to communicate with the inlet 3 connected obliquely in a circumferential direction from an outer lower side face of the supply casing 20; a bearing chamber 22 designed to house bearings; and a partition wall 23 configured to separate the supply chamber 21 from the bearing chamber 22. The receiver 2 also has a shaft hole 24 formed in the partition wall 23 to receive the rotating shaft 5 passing therethrough; a first bearing 25 attached to the shaft hole 24 to support the rotating shaft 5 in a rotatable manner; and a second bearing 26 formed on a front end (left in the drawing) of the receiver 2 to support the rotating shaft 5 in a rotatable manner at a position closer to the shaft end than to the first bearing 25.

As further shown in FIG. 2, the sieve assembly 4 comprises a sieve casing 40 formed in a reverse U-shape from the side view to have a larger diameter than that of the receiver 2; a sieving chamber 41 provided inside the sieve casing 40 to communicate with the supply chamber 21; and a hopper-shaped outlet 42 located below the sieve casing 40. The powder passes through the sieve 7 from the inner area to the outside and is discharged to a downstream line L2 via the outlet 42 provided in a lower portion of the sieve assembly 4. The cylindrical sieve 7 is located coaxially with the sieving chamber 41 to allow penetration of the rotating shaft 5 through the center thereof An inner area 43 of the sieving chamber 41 inside the sieve 7 communicates with the supply chamber 21. Namely the sieving chamber 41 has a substantially double-cylindrical structure and comprises the inner area 43 and an outer area 44 parted by the sieve 7. The sieve casing 40 is equipped with a fixing element 45 for fixation of the sieve 7.

As further shown in FIG. 2, the rotating shaft 5 is of a cantilevered structure and comprises a shaft base 50 and a free end 51 extended in the axial direction to be coaxially connected with the shaft base 50. The free end 51 of the rotating shaft 5 is extended from a front end (left in the drawing) of the sieving chamber 41 to the proximity of the rear end (right in the drawing) of the sieve 7. The shaft base 50 has one end supported by the bearings on the receiver 2 and the other end formed as the free end 51. The preferable structural design extends the rotating shaft 5 to a rear end of the drum 6 as the rotating body to ensure center alignment. As long as the drum 6 has a sufficient strength, the rotating shaft 5 may alternatively be extended only to the area of the conical body 60.

As further shown in FIG. 2, the drum 6 has a hollow shell to seal the inside. The drum 6 is connected coaxially with the rotating shaft 5 to allow penetration of the rotating shaft 5 through its inner axial center. The drum 6 comprises the conical body 60 extended forward from the sieve 7 and attached to the shaft base 50 to have a truncated head and a conical face linearly extended backward in the axial direction, a cylindrical body 61 connected with the conical body 60 and extended along the center axis of the drum 6, and a disk body 62 fixed to the circumferential rear end of the cylindrical body 61, arranged to fasten one end of the free end 51 passing therethrough in the axial direction, and bulged backward to have an arcuate shape.

The front end of the conical body 60 is extended from the inner area of the sieve 7 to the supply chamber 21 of the receiver 2 and is connected with the rotating shaft 5. The tapered structure of the conical body 60 aims to lower the resistance to the inflow of the air-powder mixture, facilitate the cleaning of the innermost wall surface, and increase the structural strength. The cylindrical body 61 is formed coaxially with the free end 51 to surround the free end 51 and is extended to the middle of the sieve 7 (to the proximity of the end of the sieve 7). The arcuate shape of the disk body 62 increases the structural strength and facilitates cleaning. A disk-shaped wheel 63 is extended radially from a joint of the shaft base 50 with the free end 51 to be in contact with the inner circumferential face of the cylindrical body 61. The wheel 63 has slits (not shown) formed in a radial direction in the outer circumferential face to hold the beaters 8 inserted therein. Ribs 64 and 65 protrude radially inward from the inner circumferential face of the cylindrical body 61 and are arranged along the circumferential direction. These ribs 64 and 65 are, however, not essential and may be omitted. The conical body 60 is not restricted to the conical shape but may be formed in any other suitable curved shape.

The distance D between the outer surface of the drum 6 and the inner surface of the sieve 7 is set to be neither excessively wide nor excessively narrow as described in detail below. To set the distance D adequately, the ratio of the (outer) diameter of the drum 6 to the (inner) diameter of the sieve 7 is particularly 40 to 85%, more particularly 45 to 85%, or most particularly 50 to 80%. The length of the drum 6 in the axial direction is set, for example, to be in a range of 50 to 100% of the axial length of the sieve 7.

The sieve 7 comprises a screen 70 having an inner diameter substantially equal to the inner diameter of the supply casing 20, and a screen fixing element 71 for fastening the screen 70 to the sieve assembly 40. The length of the sieve 7 is practically similar to the length of the sieve casing 40. In this example, the sieve 7 is fastened inside the sieve assembly 40 by means of the fixing element 45, but may be also designed in a rotatable manner (see, e.g., WO 2005/102543 A1). The sieve 7 has a smaller mesh size (for example, 0.5 mm) than a conventional sieve. The sieve 7 is attached to the sieve casing 40 in a detachable manner by means of the fixing element 45.

The beaters 8 are designed in a tornado type to form a swirling flow of the air-powder mixture. The beaters 8 are arranged along the outer circumferential face of the drum 6 and are located in the inner area 43 of the sieving chamber 41 inside the sieve 7. The beaters 8 protrude radially from the drum 6 and extend in a direction parallel to the axial direction of the rotating shaft 5. The radially-protruded ends of the beaters 8 are located close to the inner circumferential face of the sieve 7. As shown in FIG. 2, the axial front ends of the beaters 8 are located at a position of approximately ½ of the length of the supply chamber 21. The axial front ends of the beaters 8 particularly protrude to this ½ position or more forward. As shown in FIG. 3, the beaters 8 are of an even number and are arranged equally in a circumferential direction of the drum 6 to form an even number (for example, eight) of axially extending divisional spaces 47*a* to 47*h*. The air-powder mixture flows in divided amounts into these spaces 47*a* to 47*h*.

With the rotation of the drum 6, the conical body 60 spirally introduces the air-powder mixture backward. The beaters 8 are formed radially and are extended in the axial direction from the middle of the conical body 60 to the disk body 62. There are two different shapes of the beaters 8 one having a shorter front end and another having a longer front end. These two different shapes of the beaters 8 are arranged alternately around the drum 6. The front ends of the beaters 8 are extended beyond the rear end of the conical body 60, while the rear ends of the beaters 8 are extended to the periphery of the disk body 62. The radially-protruded ends of the beaters 8 face the inner circumference of the sieve 7 across a certain gap to scrape out the air-powder mixture. The axial front ends of the beaters 8 are extended over the entire length of the supply chamber 21 to be rotated at a position very close to the inner circumferential face of the supply casing 20. The axial faces of the front ends of the beaters 8 are rotated at a position very close to the inner face of the partition wall 23. The beaters 8 are inserted into the outer circumferential face of the drum 6 and are fastened to the drum 6 by welding. The preset number (for example, eight) of the beaters 8 are arranged evenly at preset intervals (for example, every 45 degrees).

The position of the beaters 8 with respect to the drum 6 is determined by taking into account both the structural design and the manufacturing cost. Welding the beaters 8 after insertion into slits formed on the drum 6 is preferential for higher strength. However, perfect welding without insertion gives a practically sufficient strength. There are clearances 66 between the drum 6 and the beaters 8. In the sifter of this example, the beaters 8 are welded to the drum 6 by tap welding. Formation of the clearances at non-welded portions facilitates cleaning.

Figure 4:
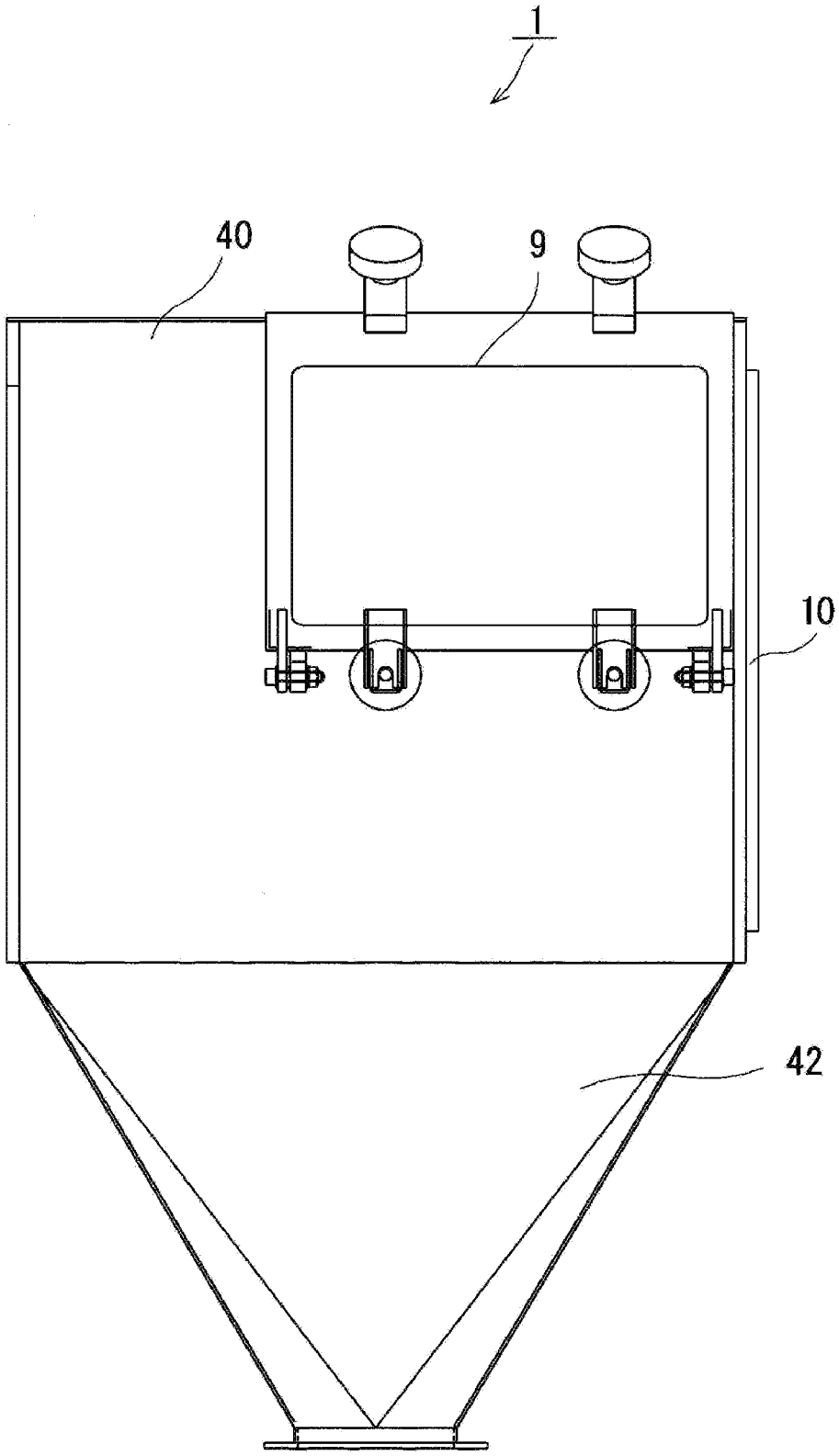
FIG. 4 is a front view showing a modified structure of the sifter described in Example 1.
Figure 5:
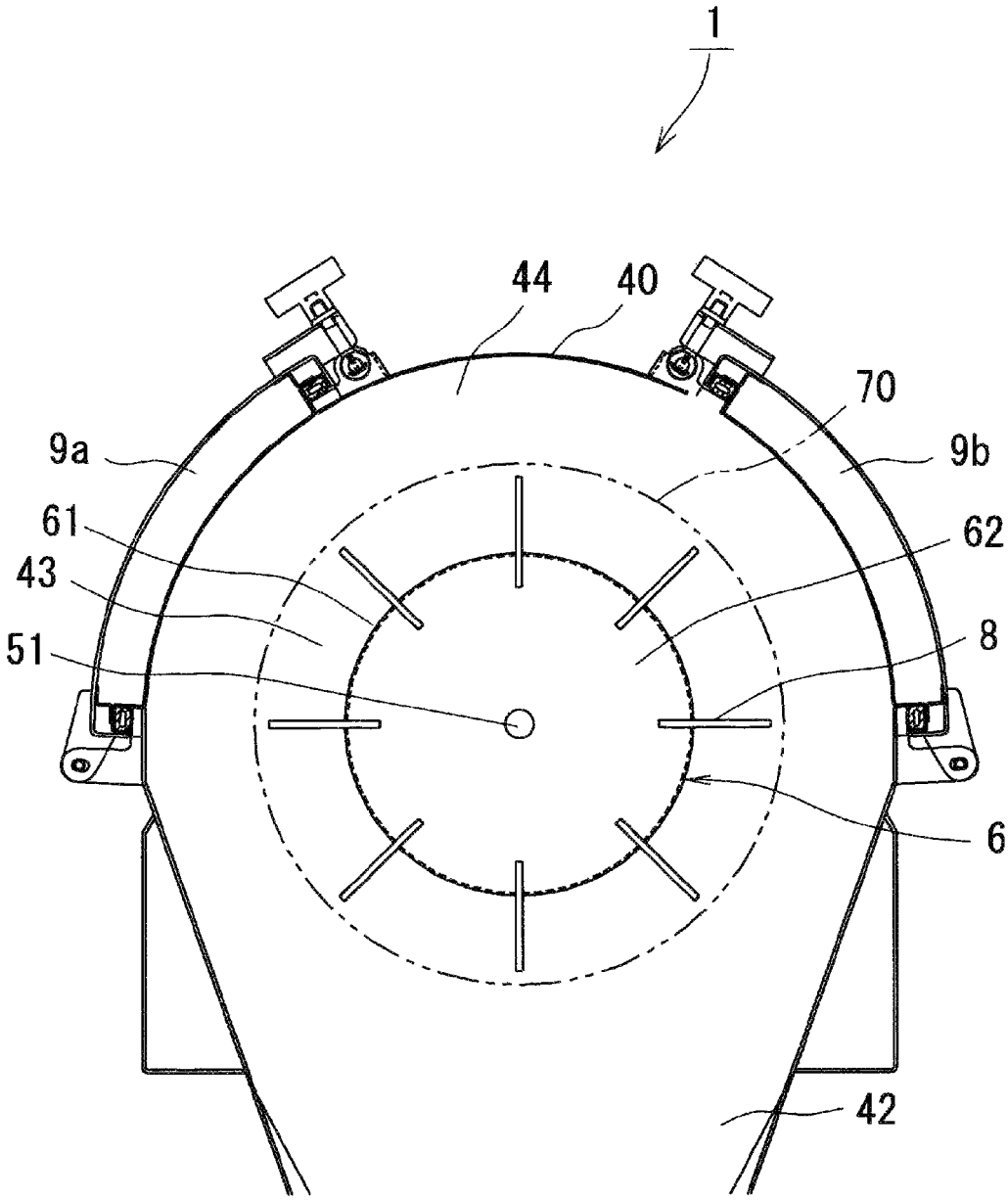
FIG. 5 is a central cross-sectional view of the modified structure shown in FIG. 5.
Figure 6:
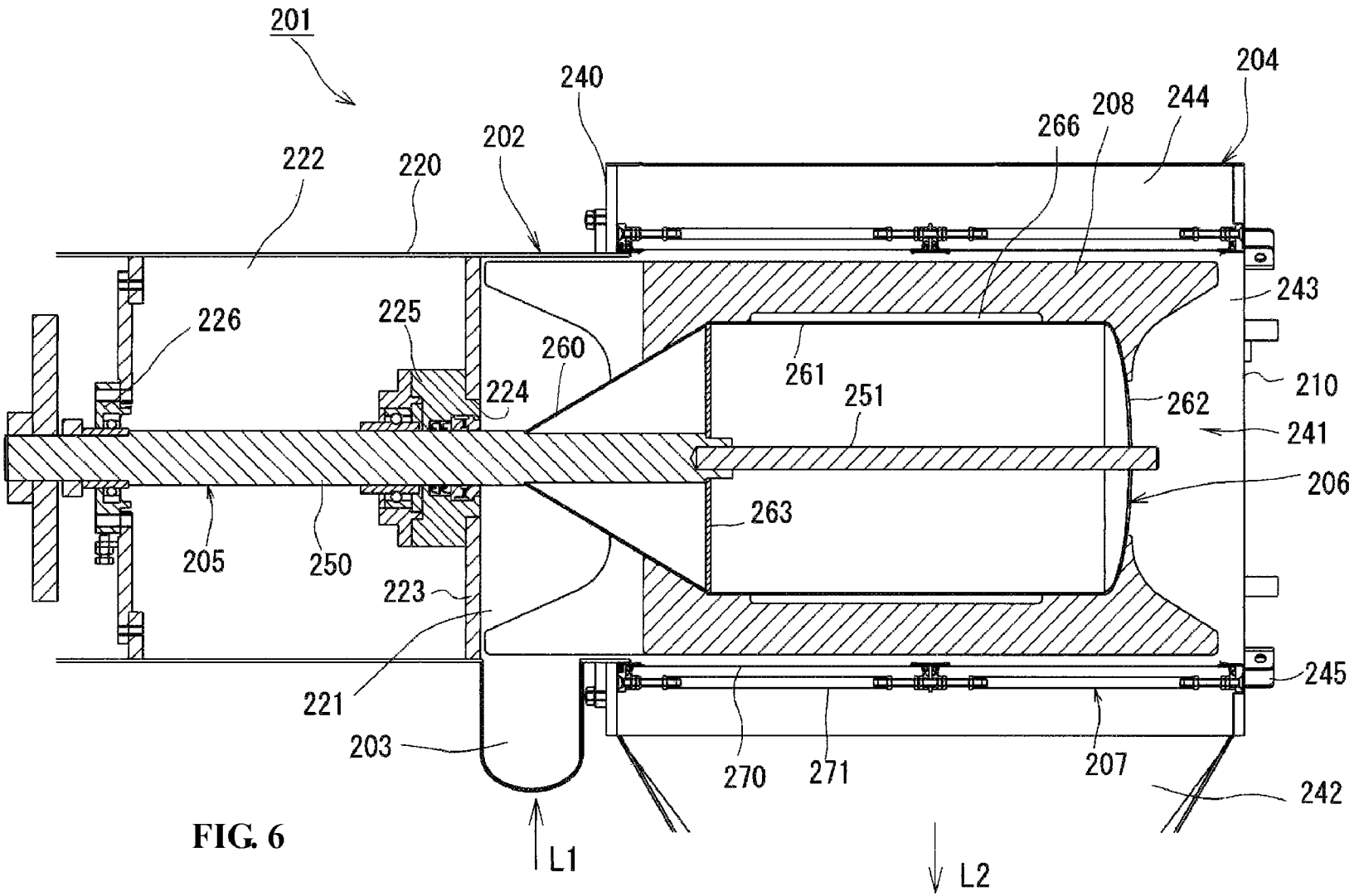
FIG. 6 is a longitudinal central cross-sectional view showing the sifter described in Example 2.

The inspection door 9 is attached with multiple fixing knobs in a detachable manner and can be opened to enable visual inspection of the inside of the sieve assembly 4 and the receiver 2. In the sifter of this example, only one inspection door 9 is formed along the upper curved face of the sieve casing 40 and extends in the axial direction to the middle of the sieve casing 40. In a modified structure, two inspection doors 9*a* and 9*b* are provided at a preset interval in the circumferential direction as shown in FIGS. 4 and 5. In the modified structure, the inspection door 9 is not located on the top of the sieve assembly 40. The advantage of the modified structure shown in FIGS. 4 and 5 is in an easy access for internal cleaning.

The operation of the in-line sifter 1 is explained with reference to FIGS. 1 to 3. The in-line sifter 1 is a pneumatic conveying in-line sieve used with a pneumatic conveying supply system. An air-powder mixture supplied from the upstream line L1 to the in-line sifter 1 by the pneumatic conveying supply system is subjected to sieving through the in-line sifter 1 in order to remove powder aggregates and foreign substances and to crush the powder aggregates, and is fed to the downstream line L2. The sieving operation of the powder inside the in-line sifter 1 is explained in detail below.

The inlet 3 is connected to the upstream line L1, and the outlet 42 is connected to the downstream line L2. The motor 11 (not shown) drives the rotating shaft 5, the drum 6, and the beaters 8. The air-powder mixture is continuously supplied from the inlet 3 into the supply chamber 21 in the direction tangential to the cylindrical receiver 2 to form a swirling flow and to be forcibly flowed inside the sieving chamber 41. The swirling flow of the air-powder mixture reaches the inner area 43 of the sieving chamber 41 inside the sieve 7 and is introduced by the rotating conical body 60 to dividedly enter cavities 47*a* through 47*h* defined by the outer circumference of the drum 6 and the beaters 8. The swirling direction of the air-powder mixture is particularly identical with the rotating direction of the rotating shaft 5.

With the rotation of the drum 6, the beaters 8 are rotated at a high speed inside the sieve 7. According to this rotation, the powder is introduced outward in the radial direction by the centrifugal force. The beaters 8 press the introduced powder against the inner face of the screen 70. Thus, the powder aggregates and foreign substances are removed and the powder aggregates are crushed.

The drum 6 occupies the space around the axial center of the inner area 43 of the sieving chamber 41 and narrows the remaining space of the inner area 43 left for retention of the powder. This increases the effective area of the screen 70 and enables the whole area of the screen 70 to be fully used for sieving. This reduces also the pressure loss and decreases the amount of air used for sieving. The space formed between the outer circumference of the drum 6 and the inner circumference of the sieve 7 is divided by the beaters 8 to disperse the flow of the air-powder mixture and to reduce the load applied to the screen 70.

Figure 19:
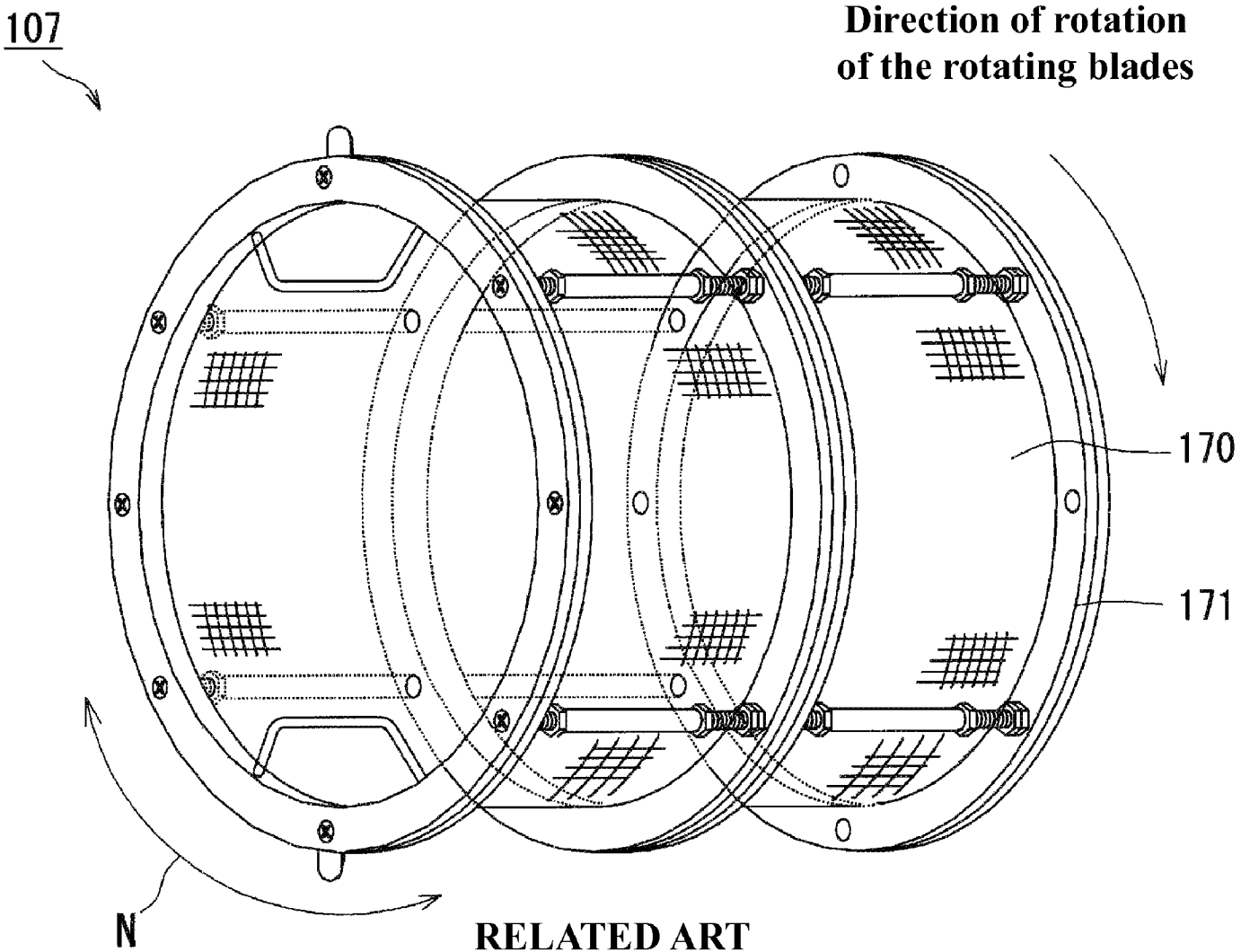
RELATED ART FIG. 19
FIG. 19 is a perspective view showing a sifter according to related art.
Figure 20:
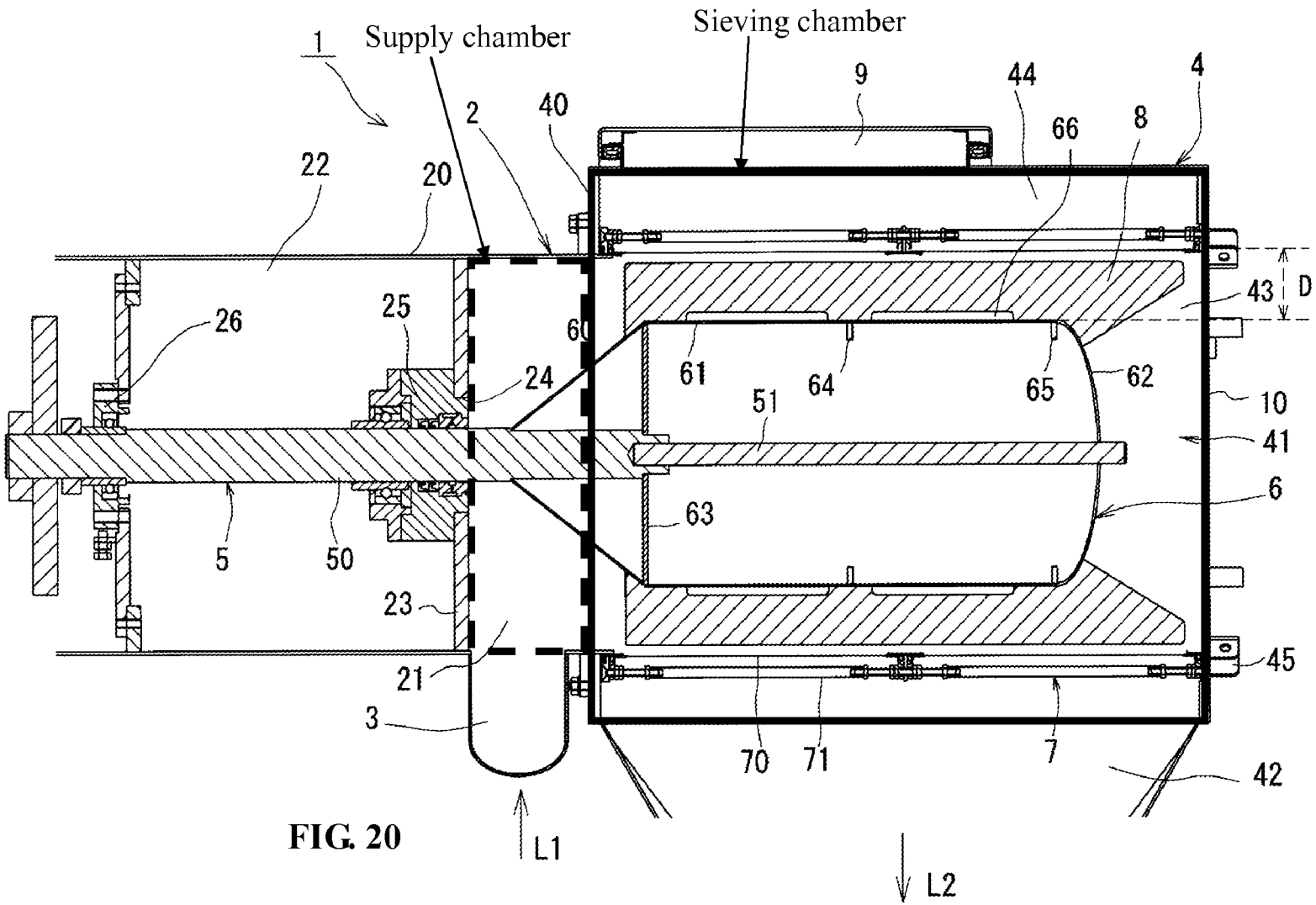
FIG. 20 is a longitudinal central cross-sectional view of the sifter described in Example 1 with the sieving chamber approximately marked by a thick continuous line and the supply chamber approximately marked by a thick dashed line.

As shown in FIG. 3, the beaters 8 divide the remaining space of the inner area 43 of the sieving chamber 41 around the drum 6 into multiple spaces 47*a* to 47*h* and are rotated with the drum 6 to sieve the powder. This disperses the load over the whole screen 70 and thereby practically equalizes the load applied to the screen 70, so that the powder smoothly and substantially equally passes through the entire area of the screen 70. This leads to a substantially-constant air flow, prevents retention of the powder in the screen bottom area N (see FIG. 19), and increases the amount of powder sieved per unit time with a decrease in floating time of the powder. The sifter of this example ensures the stable sieving efficiency, while extending the life of the screen 70 to at least 4-fold according to the design specifications.

The front end of the drum 6 protrudes into the supply chamber 21. The air-powder mixture flowing into the supply chamber 21 is thus introduced at a relatively early stage into the cavities 47*a* to 47*h* by the front end of the drum 6 and the front ends of the beaters 8. This further reduces the load applied to the screen 70. In the case of sieving a powder mixture including multiple different powders of various grain sizes, this structure lowers the potential for separation of the powders in the powder mixture and enhances the quality of the sieved powder mixture.

The air-powder mixture including powder of a grain size finer than the mesh of the screen 70 is fed to the outer area 44 of the sieving chamber 41 to reach the outlet 42 and to be discharged to the downstream line L2, while oversize powder of a grain size greater than the mesh of the screen 70 and the foreign substances remain in the inner area 43 of the sieving chamber 41.

The oversize powder and the foreign substances gradually accumulate in the inner area 43 through the repeated sieving operations of the in-line sifter 1. The accumulated oversize powder and foreign substances are discharged by opening the extraction member 10. Removal of the remaining oversize powder and foreign substances from the sieving chamber 41 enables the inside of the sieve 7 to be restored to a clean condition. A used sieve 7 is taken out of the sieving chamber 41 from the extraction member 10 and replaced by a new sieve or may be cleaned and placed back to its original position. An operator visually checks the inner state of the in-line sifter 1 through the inspection door 9, after stopping the operation of the in-line sifter 1, and loosening the fixing knobs of the inspection door 9 to open the inspection door 9.

The in-line sifter 1 of example 1 has the following features and advantages:

(1) Attachment of the drum 6 to the rotating shaft 5 narrows the sieving space of the inner area 43 to reduce the pressure loss and to decrease the amount of air used for sieving. The narrowed space increases the effective area of the screen 70 and extends the life of the screen 70. This structure prevents the powder from being accumulated on the bottom face of the screen 70 or on the outer surface of the screen 70 and ensures the stable sieving operation with homogeneous dispersion of the powder. The reduced retention of the powder shortens the floating time of the powder and increases the amount of sieved powder per unit time, thus enhancing the sieving yield. This structure also lowers the potential for separation of the powders in the powder mixture of various grain sizes.

(2) The beaters 8 are constructed by an even number of rotating blades which are arranged at equal intervals in the circumferential direction of the drum 6 to form multiple cavities of equal volume. This structure disperses the flow of the air-powder mixture equally and ensures uniform sieving.

(3) The conical body 60 of the drum 6 protrudes into the supply chamber 21 to enable smooth entry of the powder into the sieving chamber 41.

(4) The conical body 60 has a conical face to ensure further reduction of the pressure loss.

(5) The drum 6 is attached to the free end 51 of the rotating shaft 5. This arrangement desirably reduces the weight of the drum 6 and simplifies the overall structure.

EXAMPLE 2

Figure 7:
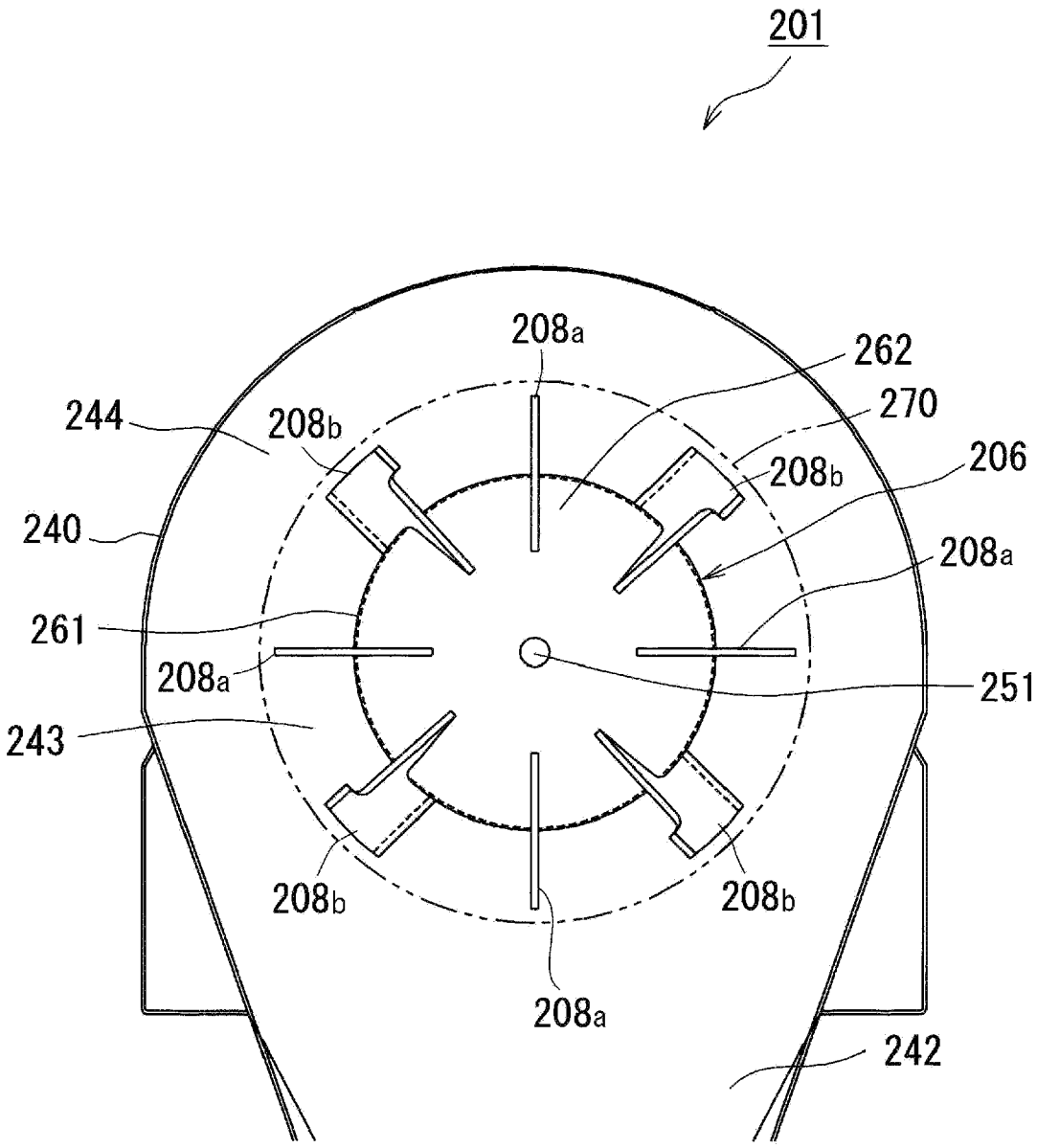
FIG. 7 is an elevational right side cross-sectional view of the sifter described in Example 2.
Figure 8:
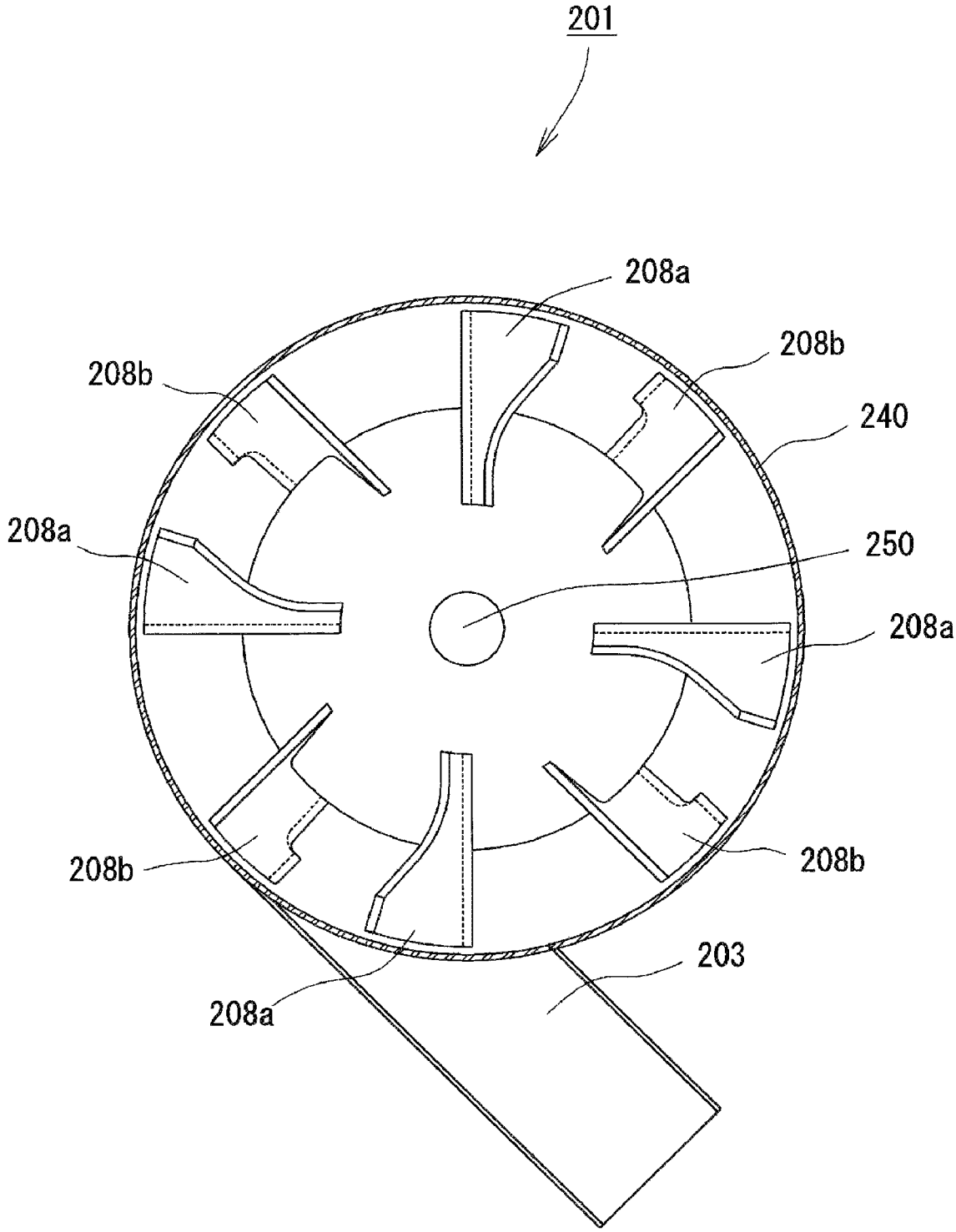
FIG. 8 is an elevational left side cross-sectional view of the sifter described in Example 2.
Figure 9:
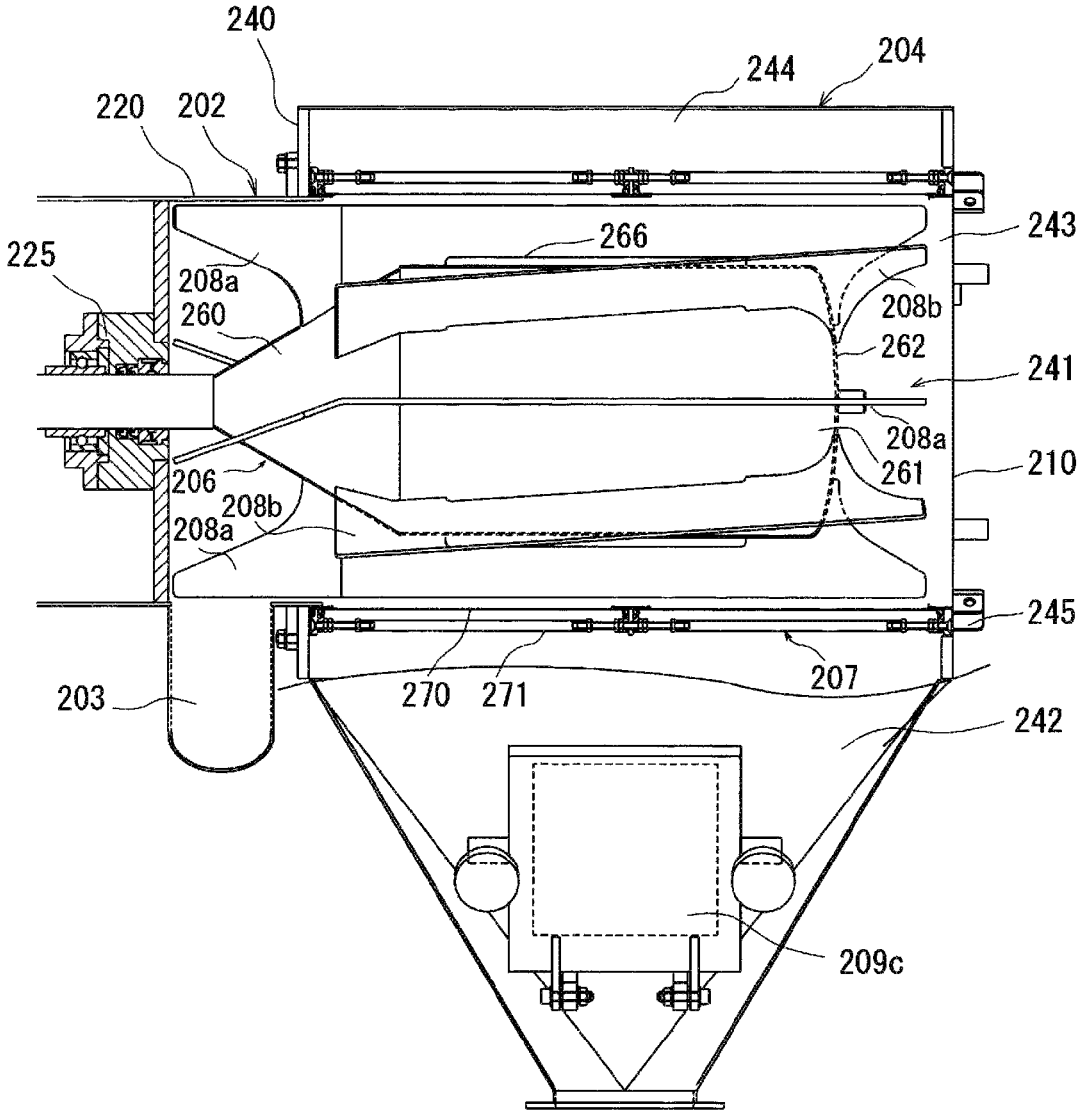
FIG. 9 is a partial cross-sectional front view of the sifter described in Example 2.
Figure 10:
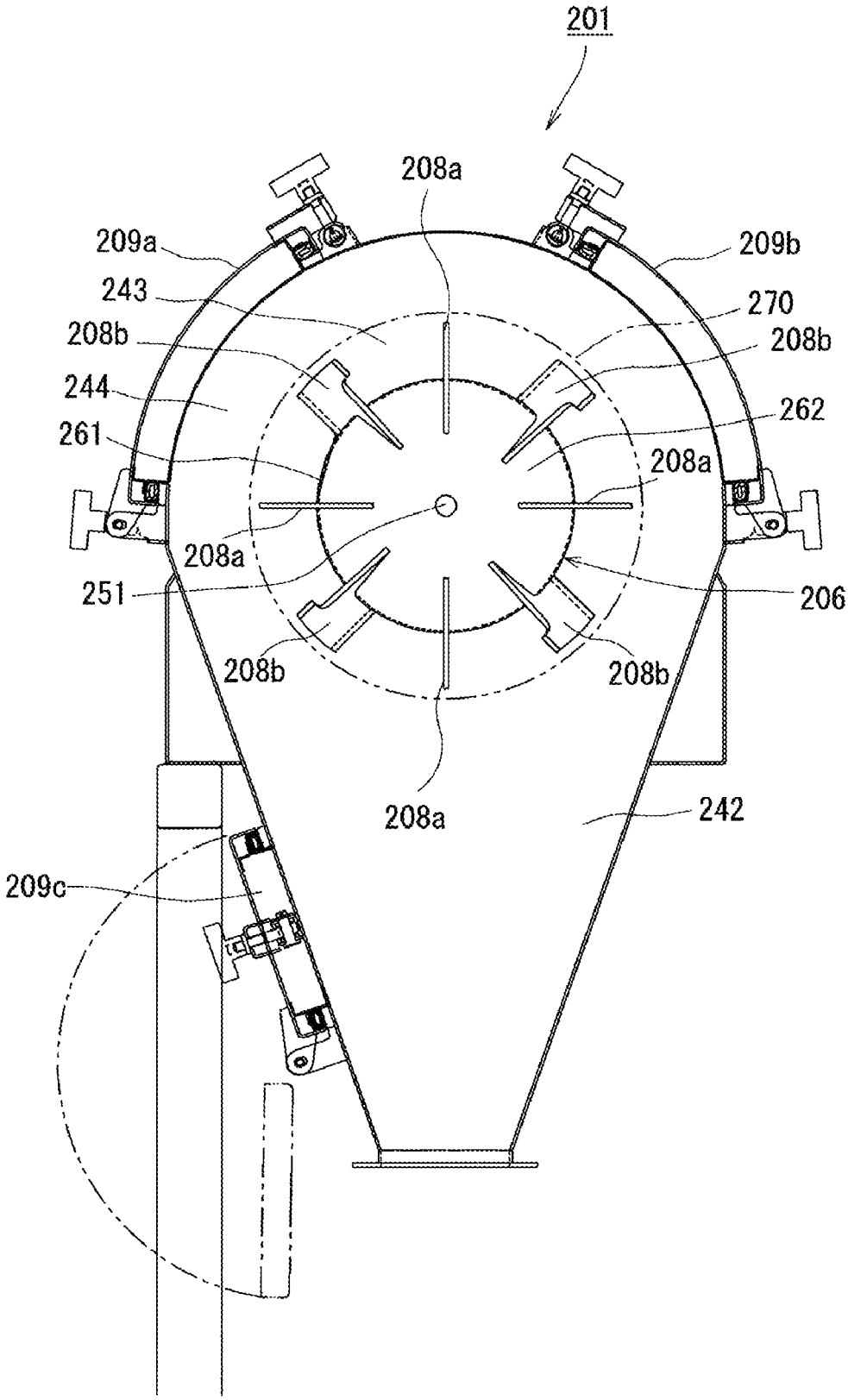
FIG. 10 is an elevational right side cross-sectional view showing a modified structure of the sifter described in Example 2.

As shown in FIGS. 6 to 9, a sifter 201 has a similar structure to that of the in-line sifter 1 in Example 1 except that beaters 208 have curved edges and that parts of the beaters 208 are inclined in an axial direction toward the drum 206, as further explained below. Like constituents are expressed by corresponding numerals after adding 200 with respect to those in example 1. As shown in FIG. 8, each of the beaters 208 has one edge curved in a rotating direction of the drum 206 and inclined in the axial direction to the drum 206 to scrape out the air-powder mixture supplied from a powder inlet 203 along the circumferential direction of the drum 206. The edges of all the beaters 208 are curved in the structure of this example, although only part of the beaters may have a curved edge. The beaters 208 include four beaters 208*a* arranged in parallel to the axial direction and four beaters 208*b* inclined to the axial direction. The beaters 208*a* have curved concave front edges and linear rear edges, whereas the beaters 208*b* have linear front edges and curved concave rear edges as shown in FIGS. 7 and 8. The beaters 208*a* with the curved front edges and the beaters 208*b* with the curved rear edges are alternately arranged along the outer circumference of the drum 206. An inspection door 209*c* is provided at an outlet 242. A modified structure shown in FIG. 10 has two inspection doors 209*a* and 209*b* provided on the left and right sides of a sieve casing 240, similar to the modified structure described in example 1 and shown in FIGS. 4 and 5.

EXAMPLE 3

Figure 11:
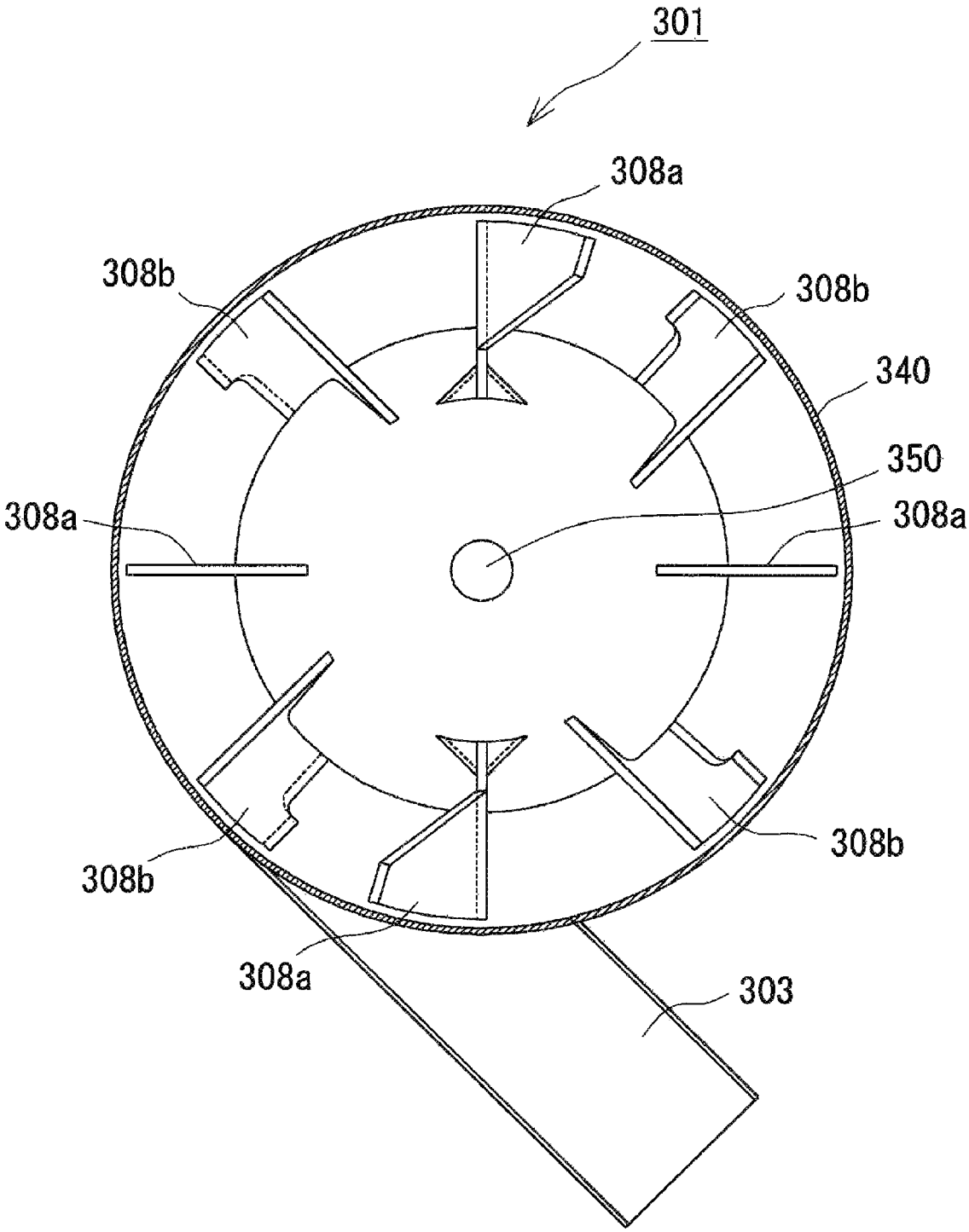
FIG. 11 is an elevated left side cross-sectional view along a line in the vicinity of the receiver showing the sifter described in Example 3.
Figure 12:
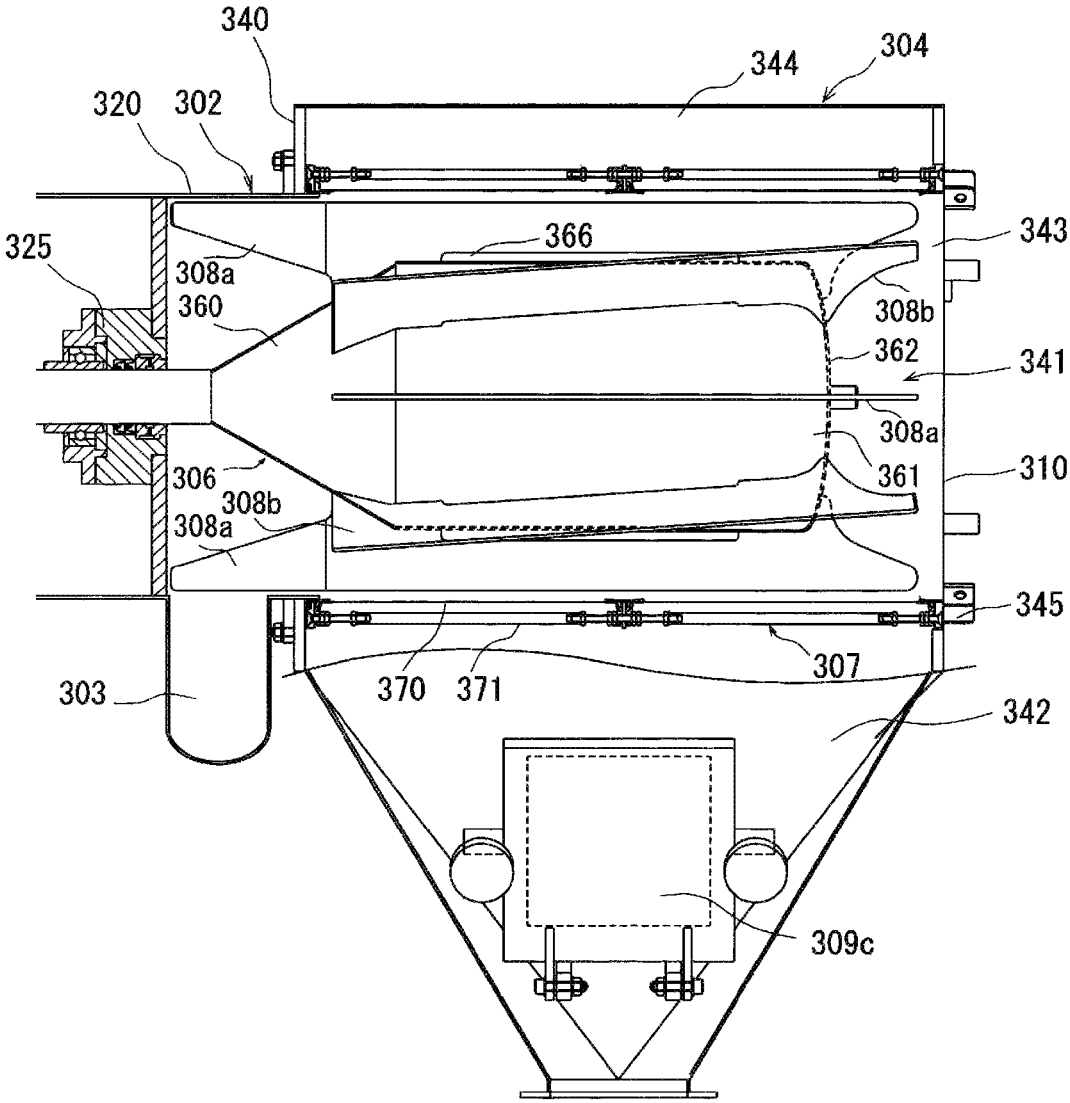
FIG. 12 is a partial cross-sectional front view showing the sifter described in Example 3.
Figure 13A:
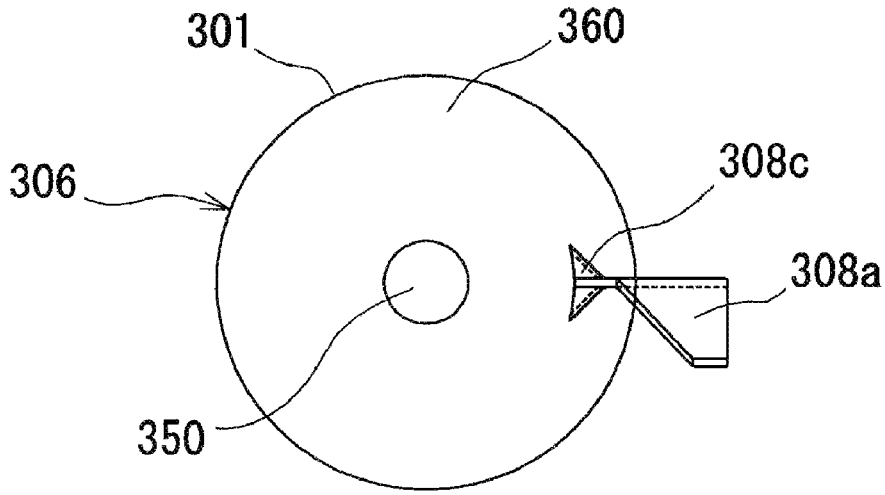
FIGS. 13(*a*), 13(*b*), and 13(*c*) are side, front, and a plan views, respectively, showing a drum and an edge of a beater in the sifter described in Example 3.
Figure 13B:
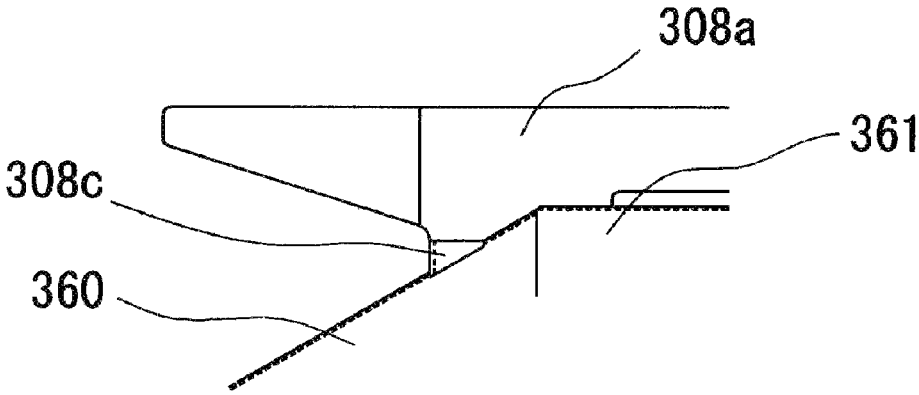
Figure 13C:
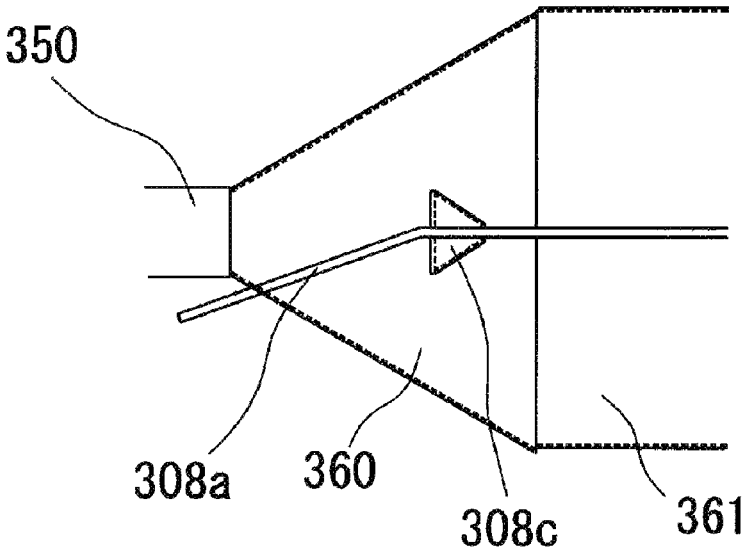

With reference to FIGS. 11 to 13, a sifter 301 has a similar structure to that of the sifter 201 described in example 2, except that some beaters 308 have linear edges and some beaters 308 have reinforced curved edges as explained below. Like constituents are expressed by corresponding numerals after adding 300 with respect to those in example 1. The beaters 308 include four beaters 308*a* arranged in parallel to an axial direction and four beaters 308*b* inclined to the axial direction. The beaters 308*a* and the beaters 308*b* are alternately arranged along the outer circumference of a drum 306. Among the four beaters 308*a*, one pair of the beaters 308*a* opposed to each other have linear front edges, while the other pair of the beaters 308*a* opposed to each other have curved front edges. The curved front edges of the beaters 308*a* are reinforced by triangular ribs 308*c*.

EXAMPLE 4

Figure 14:
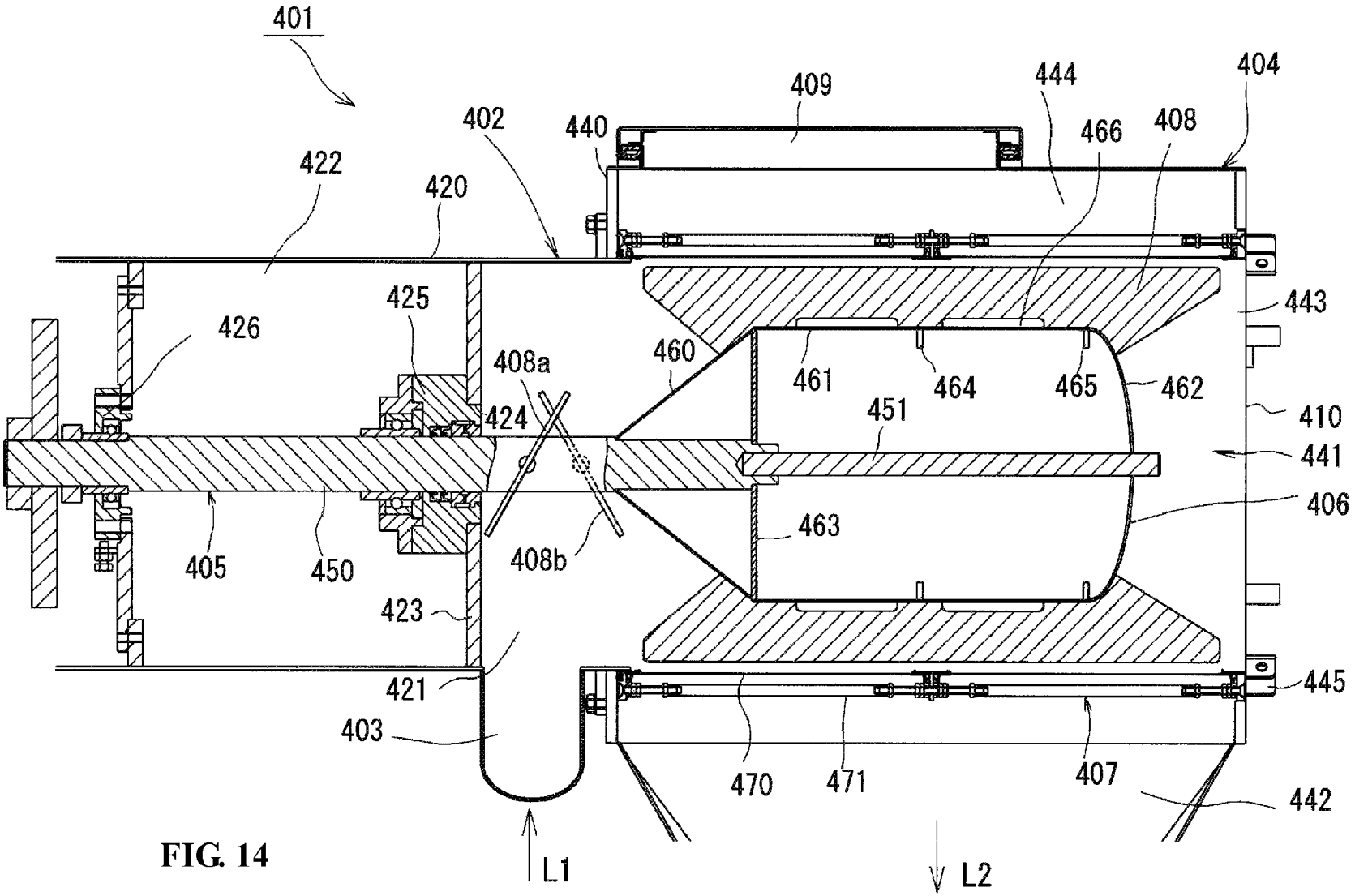
FIG. 14 is a longitudinal central cross-sectional view showing the sifter described in Example 4.

With reference to FIG. 14, a sifter 401 has a similar structure to that of the in-line sifter 1 described in example 1, except that paddles 408*a* and 408*b* are extended in the radial direction and are attached to the shaft base 450 in the supply chamber 421. Beaters 408 do not protrude into the supply chamber 421 to avoid collision with paddles 408*a* and 408*b* but are limited to the inner area 443 of the sieving chamber 441. Llike constituents are expressed by corresponding numerals after adding 400 with respect to those in example 1.

EXAMPLE 5

Figure 15:
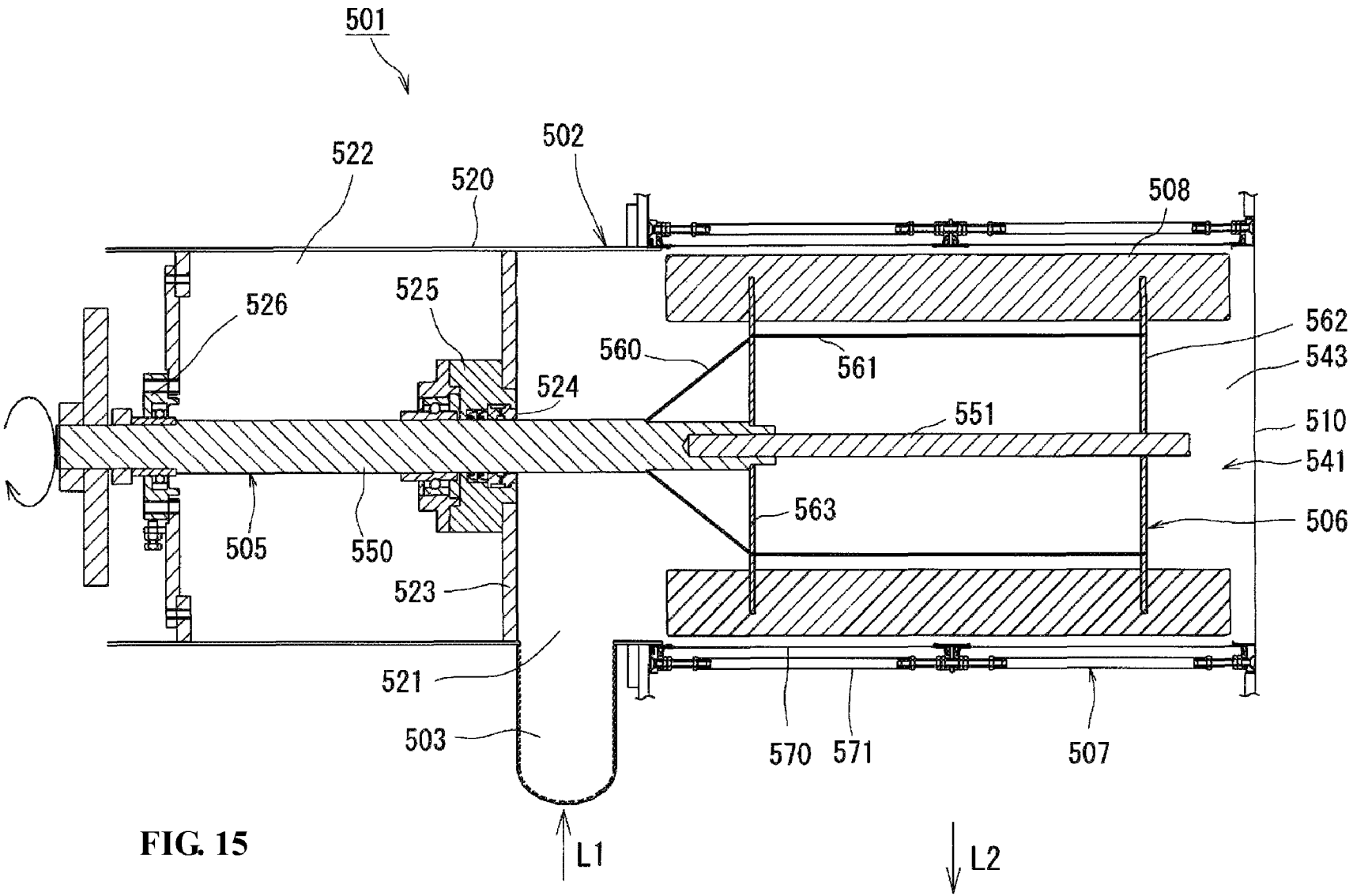
FIG. 15 is a longitudinal central cross-sectional view showing the sifter described in Example 5.
Figure 16:
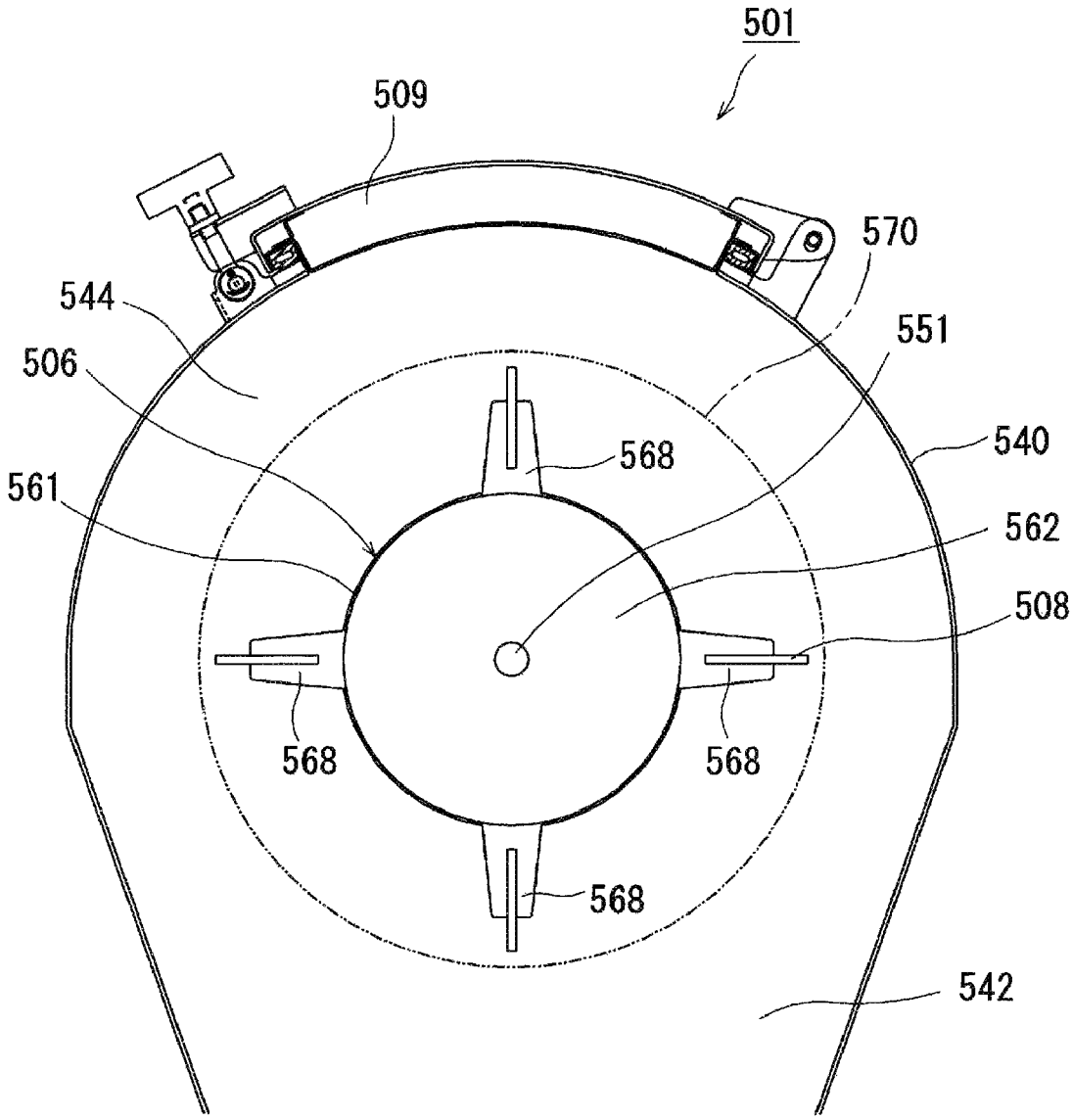
FIG. 16 is a right side cross-sectional view showing the sifter described in Example 5.
Figure 17:
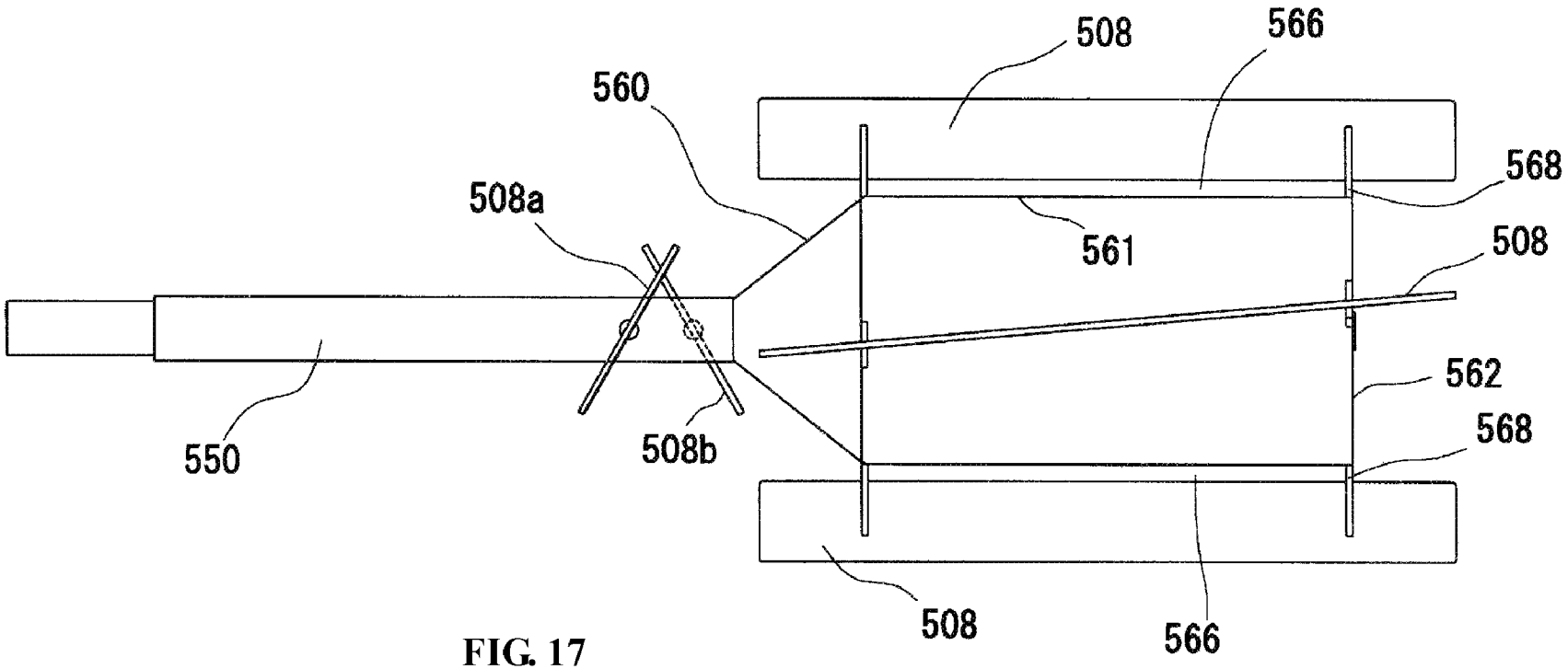
FIG. 17 is a front view showing a rotating a shaft, a drum, and beaters in the sifter described in Example 5.

With reference FIGS. 15 to 17, a sifter 501 has paddles 508*a* and 508*b*, similar to the sifter 401 in example 4. Beaters 508 are fastened by support members 568 extended radially from the outer circumference of the drum 506. The beaters 508 are set in the edges of the respective support members 568. The beaters 508 are inclined to an axial direction of the drum 506 at a preset angle in the range of 3 to 7 degrees, and particularly, in this example at the angle of 5 degrees. There is a clearance 566 formed between the drum 506 and the beaters 508 to reduce retention of the powder on the outer surface of the drum 506. Four beaters 508 are arranged at 90 degree intervals. In the sifter of this example, the beater 508 has a long rectangular shape as seen from the front view.

EXAMPLE 6

Figure 18:
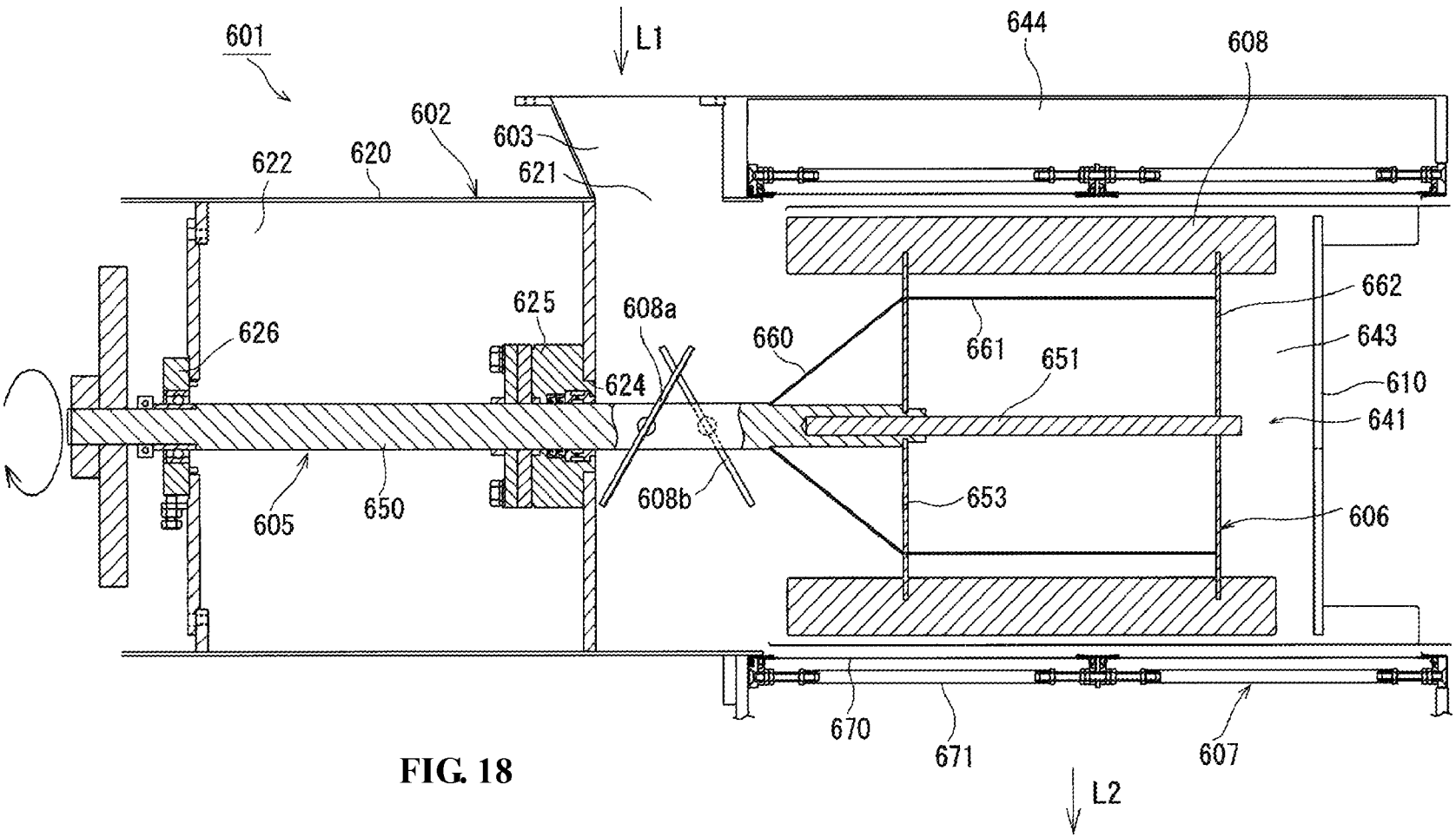
FIG. 18 is a longitudinal central cross-sectional view showing the sifter described in Example 6.

As shown in FIG. 18, in the chute sifter 601, the powder falls from the inlet 603 open above a supply casing 620 into a supply chamber 621 by the gravity, is stirred with a pair of paddles 608*a* and 608*b*, and is fed into the sieving chamber 641. In other respects, the structure of the chute sifter 601 including the drum 606 is similar to that of the sifter 501 described in example 5. Like constituents are expressed by corresponding numerals after adding 600 with respect to those in example 1. The structures adopted in the in-line sifters described in examples 1 to 4 are also applicable to chute sifters.

EXAMPLE 7

Figure 21:
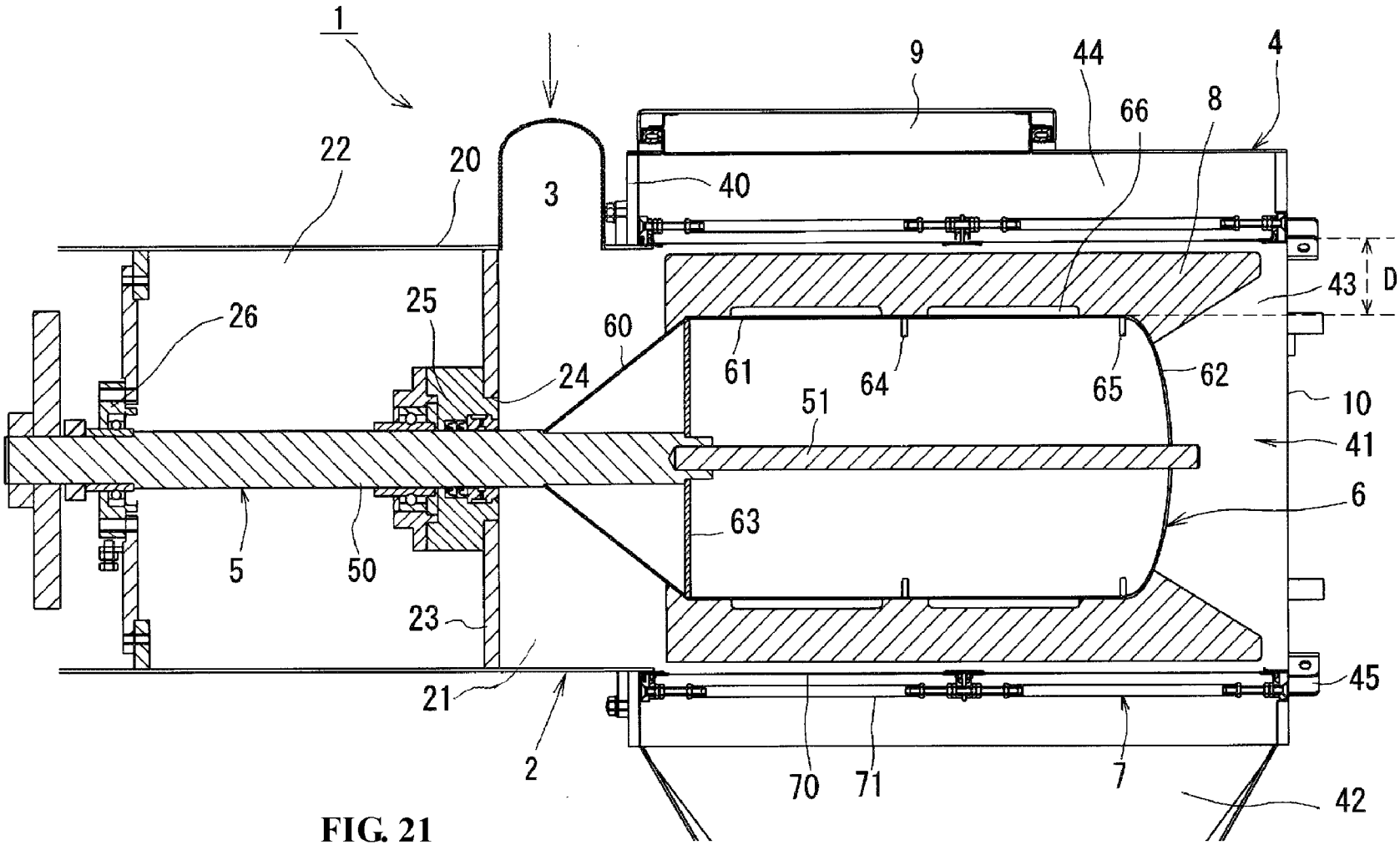
FIG. 21 is a longitudinal central cross-sectional view of the sifter described in Example 7.

With reference to FIG. 21, a stand-alone sifter 1 (as opposed to an inline sifter) with a mount (not shown) having support legs (not shown) comprises a receiver 2 designed to receive powder to be sifted; an inlet 3 connected to the receiver 2 and configured to introduce the powder, e.g., by pouring or dropping the powder to be sifted into the receiver 2; a sieve assembly 4 coupled and communicating with the receiver 2 in a lateral direction; a rotating shaft 5 arranged in a horizontal direction to pass through the inside of the receiver 2 and the sieve assembly 4; a drum 6 attached to the rotating shaft 5, formed across the area of the receiver 2 and the sieve assembly 4 to have a larger diameter than that of the rotating shaft 5, and arranged in an axial direction of the rotating shaft 5 to be coaxial with a cylindrical sieve 7; and the cylindrical sieve 7 provided inside the sieve assembly 4, arranged around the rotating shaft 5 and the drum 6 to be coaxial with the rotating shaft 5 and the drum 6, and formed to have an inside communicating with the receiver 2. In operation, the powder passes through the sieve 7 from the inner area to the outside and is discharged via the outlet 42 provided in a lower portion of the sieve assembly 4. In other aspects, the stand-alone sifter 1 adapted for receiving powders to be sifted described in this Example is similar to the in-line sifter 1 described in Example 1.

The examples discussed above are to be considered in all aspects as illustrative and not restrictive. There may be many modifications, changes, and alterations without departing from the scope or spirit of the main characteristics of the present invention. All changes within the meaning and range of equivalency of the claims are intended to be embraced therein. The characteristic of the invention is attainable by both in-line sifters and chute sifters with or without a screw feeder. In the sifters, a sieve 7 may be fixed or movable (see, e.g., WO 2005/102543 A1). The structure with paddles may also be adopted in both in-line sifters and chute sifters.

All publications and patent applications mentioned in this specification are indicative of the level of skill of those skilled in the art to which this invention pertains. All publications and patent applications mentioned in this specification are herein incorporated by reference to the same extent as if each individual publication or patent application mentioned in this specification was specifically and individually indicated to be incorporated by reference.

The claimed invention is:

1. A stand-alone sifter comprising:

a receiver having a supply chamber and designated to receive powder to be sifted;

an inlet connected to said receiver and configured to introduce to said receiver by pouring or dropping the powder to be sifted;

a sieve assembly having a sieving chamber, said sieving chamber having an inner area and an outer area, said sieve assembly being coupled to and communicating with said supply chamber;

a rotor having a rotating shaft laterally arranged to pass through said supply chamber and said sieving chamber;

a cylindrical sieve located inside said sieving chamber and arranged coaxially with said rotating shaft;

a hollow drum having an inner circumferential face and an outer circumferential face, having a circular cross-section, and having a larger diameter than the diameter of said rotating shaft, said hollow drum being extended in at least space of said sieving chamber and arranged coaxially with said cylindrical sieve in an axial direction of said rotating shaft, and said hollow drum having a front end extending from said inner area of said sieving chamber inside said cylindrical sieve to said supply chamber;

a stirring rotor located in said inner area of said sieving chamber inside said cylindrical sieve, said stirring rotor comprising a plurality of rotating blades attached to said rotating shaft to push the powder to be sifted from said inner area to said outer area of said sieving chamber outside said cylindrical sieve, said stirring rotor being attached to said outer circumferential face of said hollow drum;

an extraction member for enabling removal of oversize powder or foreign substances trapped by said cylindrical sieve from said inner area; and an outlet for discharging powder passing through said cylindrical sieve from said inner area to said outer area, wherein a paddle for moving said powder from said supply chamber to said sieving chamber is attached to said rotating shaft in said supply chamber; and a ratio of an outer diameter of said hollow drum to an inner diameter of said sieve is between 40 and 85%.

2. A stand-alone sifter comprising:

a receiver having a supply chamber and designated to receive powder to be sifted;

an inlet connected to said receiver and configured to introduce to said receiver by pouring or dropping said powder to be sifted;

a sieve assembly having a sieving chamber, said sieving chamber having an inner area and an outer area, said sieve assembly being coupled to and communicating with said supply chamber;

a rotor having a rotating shaft laterally arranged to pass through said supply chamber and said sieving chamber;

a cylindrical sieve located inside said sieving chamber and arranged coaxially with said rotating shaft;

a hollow drum having an inner circumferential face and an outer circumferential face, having a circular cross-section, and having a larger diameter than the diameter of said rotating shaft, said hollow drum being extended in at least space of said sieving chamber and arranged coaxially with said cylindrical sieve in an axial direction of said rotating shaft, and said hollow drum having a front end extending from said inner area of said sieving chamber inside said cylindrical sieve to said supply chamber;

a stirring rotor located in said inner area of said sieving chamber inside said cylindrical sieve, said stirring rotor comprising a plurality of rotating blades attached to said rotating shaft to push the powder to be sifted from said inner area to said outer area of said sieving chamber outside said cylindrical sieve, said stirring rotor being attached to said outer circumferential face of said hollow drum;

an extraction member for enabling removal of oversize powder or foreign substances trapped by said cylindrical sieve from said inner area; and an outlet for discharging powder passing through said cylindrical sieve from said inner area to said outer area, wherein said stirring rotor protrudes into said supply chamber in the axial direction of said rotating shaft for moving said powder from said supply chamber to said sieving chamber, and a ratio of an outer diameter of said hollow drum to an inner diameter of said sieve is between 40 and 85%.

* * * * *